US009529309B2

(12) United States Patent
Ishii et al.

(10) Patent No.: US 9,529,309 B2
(45) Date of Patent: Dec. 27, 2016

(54) FIXING DEVICE AND IMAGE FORMING APPARATUS INCLUDING A MULTI-LAYER NIP FORMATION PAD

(71) Applicants: Kenji Ishii, Kanagawa (JP); Hiromasa Takagi, Tokyo (JP); Takayuki Seki, Kanagawa (JP); Keitaro Shoji, Kanagawa (JP)

(72) Inventors: Kenji Ishii, Kanagawa (JP); Hiromasa Takagi, Tokyo (JP); Takayuki Seki, Kanagawa (JP); Keitaro Shoji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/531,313

(22) Filed: Nov. 3, 2014

(65) Prior Publication Data

US 2015/0125193 A1 May 7, 2015

(30) Foreign Application Priority Data

Nov. 7, 2013 (JP) ..... 2013-231017
Aug. 8, 2014 (JP) ..... 2014-162177

(51) Int. Cl.
*G03G 15/20* (2006.01)

(52) U.S. Cl.
CPC ..... *G03G 15/2053* (2013.01); *G03G 15/2042* (2013.01); *G03G 2215/2025* (2013.01);
(Continued)

(58) Field of Classification Search
CPC ..... G03G 15/2053; G03G 15/2042; G03G 2215/2025; G03G 2215/2029; G03G 2215/2032; G03G 2215/2035; G03G 2215/2038
See application file for complete search history.

(56) References Cited

U.S. PATENT DOCUMENTS 8,903,296 B2 12/2014 Shimokawa et al.
2009/0067901 A1* 3/2009 Lee ..... G03G 15/2053 399/329
(Continued)

FOREIGN PATENT DOCUMENTS

CN 101369126 A 2/2009
CN 103019077 A 4/2013
(Continued)

OTHER PUBLICATIONS

U.S. Appl. No. 14/467,135, filed Aug. 25, 2014.
(Continued)

*Primary Examiner* — Joseph S Wong
(74) *Attorney, Agent, or Firm* — Oblon, McClelland, Maier & Neustadt, L.L.P.

(57) ABSTRACT

A fixing device includes a fixing rotator, a nip formation pad disposed opposite an inner circumferential surface of the fixing rotator, and a pressure rotator pressed against the nip formation pad via the fixing rotator to form a fixing nip between the fixing rotator and the pressure rotator, through which a recording medium is conveyed. A support is disposed opposite the pressure rotator via the nip formation pad to support the nip formation pad against pressure from the pressure rotator. The nip formation pad conducts heat in a thickness direction thereof perpendicular to an axial direction of the fixing rotator and a recording medium conveyance direction. The nip formation pad includes a multi-conductivity layer having a thermal conductivity varying in the axial direction of the fixing rotator and a support side layer contacting the support and having a thermal conductivity greater than a thermal conductivity of the support.

20 Claims, 13 Drawing Sheets

(52) U.S. Cl.
CPC ..... *G03G 2215/2029* (2013.01); *G03G 2215/2032* (2013.01); *G03G 2215/2035* (2013.01); *G03G 2215/2038* (2013.01)

(56) References Cited

U.S. PATENT DOCUMENTS

| | | | | |
|---|---|---|---|---|
| 2012/0177423 | A1 | 7/2012 | Imada et al. | |
| 2014/0286684 | A1 | 9/2014 | Takagi et al. | |
| 2015/0055993 | A1* | 2/2015 | Shoji ..... | G03G 15/2053 399/329 |

FOREIGN PATENT DOCUMENTS

| | | |
|---|---|---|
| JP | 11-260533 | 9/1999 |
| JP | 2003-257592 | 9/2003 |
| JP | 2010-032625 | 2/2010 |
| JP | 2012-145709 | 8/2012 |

OTHER PUBLICATIONS

U.S. Appl. No. 14/467,341, filed Aug. 25, 2014.
U.S. Appl. No. 14/504,626, filed Oct. 2, 2014.
Combined Office Action and Search Report issued on Jul. 22, 2016 in Chinese Patent Application No. 201410592235.4 with English translation of category of cited documents.

* cited by examiner

FIXING DEVICE AND IMAGE FORMING APPARATUS INCLUDING A MULTI-LAYER NIP FORMATION PAD

CROSS-REFERENCE TO RELATED APPLICATIONS

This patent application is based on and claims priority pursuant to 35 U.S.C. §119 to Japanese Patent Application Nos. 2013-231017, filed on Nov. 7, 2013, and 2014-162177, filed on Aug. 8, 2014, in the Japanese Patent Office, the entire disclosure of each of which is hereby incorporated by reference herein.

BACKGROUND

Technical Field

Exemplary aspects of the present invention relate to a fixing device and an image forming apparatus, and more particularly, to a fixing device for fixing an image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a heater disposed opposite the fixing rotator to heat the fixing rotator. A nip formation pad is disposed opposite an inner circumferential surface of the fixing rotator. A pressure rotator is pressed against the nip formation pad via the fixing rotator to form a fixing nip between the fixing rotator and the pressure rotator, through which a recording medium is conveyed. A support is disposed opposite the pressure rotator via the nip formation pad to support the nip formation pad against pressure from the pressure rotator. The nip formation pad conducts heat in a thickness direction thereof perpendicular to an axial direction of the fixing rotator and a recording medium conveyance direction. The nip formation pad includes a multi-conductivity layer having a thermal conductivity varying in the axial direction of the fixing rotator and a support side layer contacting the support and having a thermal conductivity greater than a thermal conductivity of the support.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and a heater disposed opposite the fixing rotator to heat the fixing rotator. A nip formation pad is disposed opposite an inner circumferential surface of the fixing rotator. A pressure rotator is pressed against the nip formation pad via the fixing rotator to form a fixing nip between the fixing rotator and the pressure rotator, through which a recording medium is conveyed. A support is disposed opposite the pressure rotator via the nip formation pad to support the nip formation pad against pressure from the pressure rotator. The nip formation pad conducts heat in a thickness direction thereof perpendicular to an axial direction of the fixing rotator and the recording medium conveyance direction. The nip formation pad includes a multi-conductivity layer having a thermal conductivity varying in the axial direction of the fixing rotator and a support side layer contacting the support and having a thermal conductivity greater than a thermal conductivity of the support.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
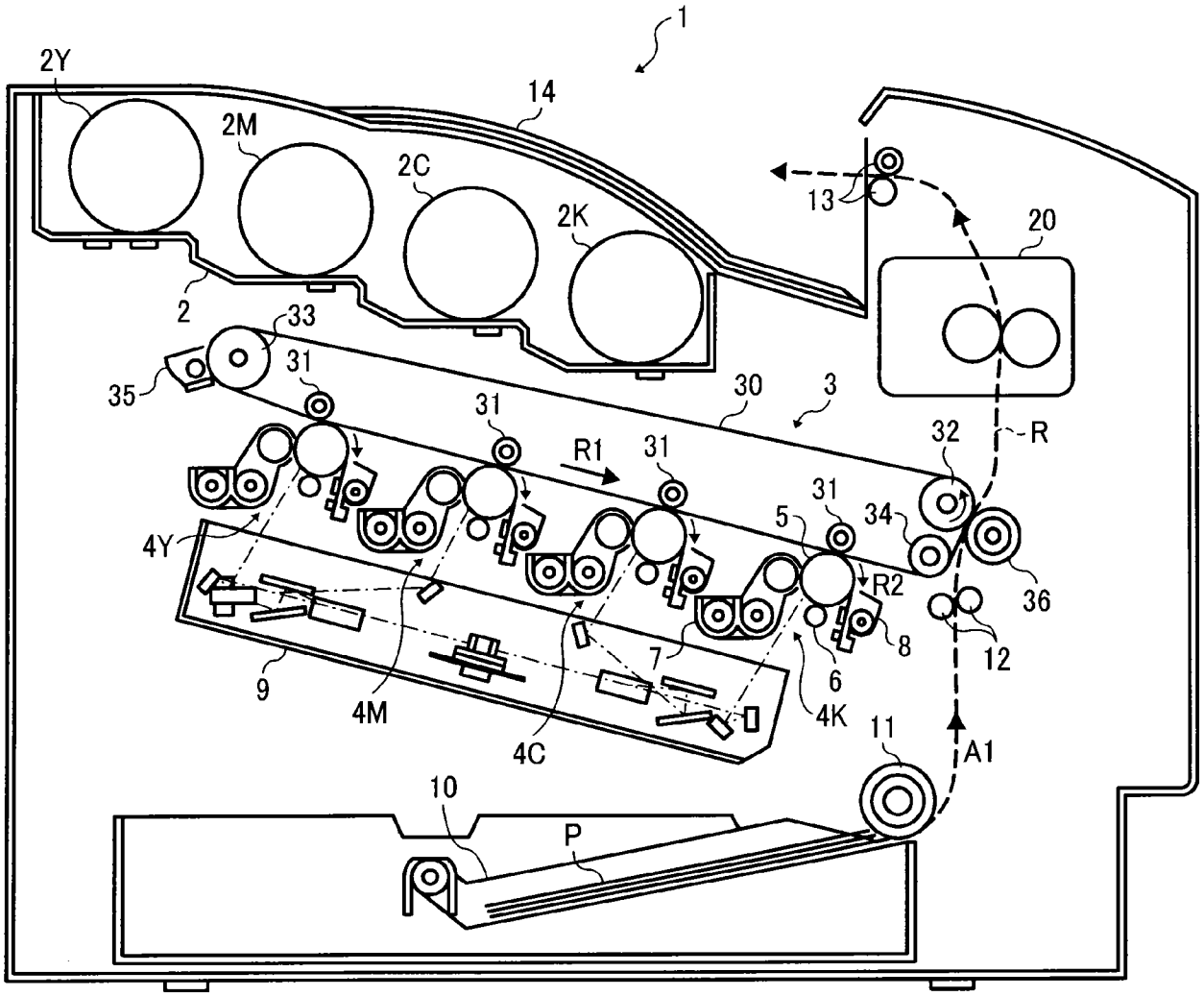
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., yellow, magenta, cyan, and black toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyance roller pair or a timing roller pair feeds the sheet P conveyed from the feed roller 11 toward the secondary transfer nip at a proper time.

The conveyance path R is further provided with a fixing device 20 located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip. The conveyance path R is further provided with the output roller pair 13 located above the fixing device 20, that is, downstream from the fixing device 20 in the sheet conveyance direction A1. The output roller pair 13 discharges the sheet P bearing the fixed toner image onto the outside of the image forming apparatus 1, that is, an output tray 14 disposed atop the image forming apparatus 1. The output tray 14 stocks the sheet P discharged by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images constituting the color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the color toner image is conveyed to the fixing device 20 that fixes the color toner image on the sheet P. Then, the sheet P bearing the fixed color toner image is discharged by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
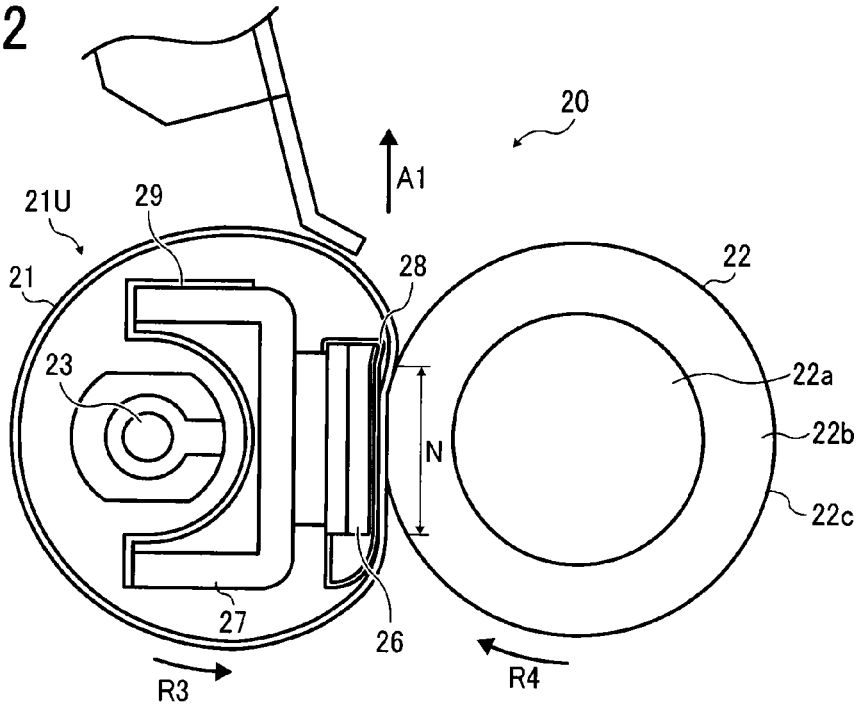
FIG. 2 is a schematic vertical sectional view of a fixing device incorporating a single halogen heater installed in the image forming apparatus shown in FIG. 1.

With reference to FIG. 2, a description is provided of a construction of the fixing device 20 incorporated in the image forming apparatus 1 described above.

FIG. 2 is a schematic vertical sectional view of the fixing device 20. As shown in FIG. 2, the fixing device 20 (e.g., a fuser) includes a fixing belt 21 serving as a fixing rotator or an endless belt formed into a loop and rotatable in a rotation direction R3; a pressure roller 22 serving as a pressure rotator disposed opposite an outer circumferential surface of the fixing belt 21 to separably or unseparably contact the fixing belt 21 and rotatable in a rotation direction R4 counter to the rotation direction R3 of the fixing belt 21; a halogen heater 23 serving as a heater disposed inside the loop formed by the fixing belt 21 to heat the fixing belt 21 directly with light irradiating an inner circumferential surface of the fixing belt 21; a nip formation pad 26 disposed inside the loop formed by the fixing belt 21 and pressing against the pressure roller 22 via the fixing belt 21 to form a fixing nip N between the fixing belt 21 and the pressure roller 22; a stay 27 serving as a support disposed inside the loop formed by the fixing belt 21 and contacting and supporting the nip formation pad 26; and a reflector 29 disposed inside the loop formed by the fixing belt 21 to reflect light radiated from the halogen heater 23 toward the fixing belt 21. The fixing belt 21 and the components disposed inside the loop formed by the fixing belt 21, that is, the halogen heater 23, the nip formation pad 26, the stay 27, and the reflector 29, may constitute a belt unit 21U separably coupled with the pressure roller 22.

A detailed description is now given of a configuration of the nip formation pad 26.

The nip formation pad 26 disposed opposite the pressure roller 22 via the fixing belt 21 presses against the pressure roller 22 via the fixing belt 21 to form the fixing nip N between the fixing belt 21 and the pressure roller 22. As the fixing belt 21 rotates in the rotation direction R3, the inner circumferential surface of the fixing belt 21 slides over the nip formation pad 26 directly or indirectly via a slide sheet sandwiched between the fixing belt 21 and the nip formation pad 26.

As shown in FIG. 2, the fixing nip N is planar. Alternatively, the fixing nip N may be contoured into a curve or other shapes. If the fixing nip N is curved, the curved fixing nip N directs a leading edge of the sheet P toward the pressure roller 22 as the sheet P is discharged from the fixing nip N, facilitating separation of the sheet P from the fixing belt 21 and suppressing jamming of the sheet P.

A detailed description is now given of a construction of the fixing belt 21.

The fixing belt 21 is an endless belt or film made of metal such as nickel and SUS stainless steel or resin such as polyimide. The fixing belt 21 is constructed of a base layer and a release layer. The release layer constituting an outer surface layer is made of tetrafluoroethylene-perfluoroalkylvinylether copolymer (PFA), polytetrafluoroethylene (PTFE), or the like to facilitate separation of toner of the toner image on the sheet P from the fixing belt 21. An elastic layer may be sandwiched between the base layer and the release layer and made of silicone rubber or the like. If the fixing belt 21 does not incorporate the elastic layer, the fixing belt 21 has a decreased thermal capacity that improves fixing property of being heated quickly to a predetermined fixing temperature at which the toner image is fixed on the sheet P. However, as the pressure roller 22 and the fixing belt 21 sandwich and press the toner image on the sheet P passing through the fixing nip N, slight surface asperities of the fixing belt 21 may be transferred onto the toner image on the sheet P, resulting in variation in gloss of the solid toner image that may appear as an orange peel image on the sheet P. To address this circumstance, the elastic layer made of silicone rubber has a thickness not smaller than about 100 micrometers. As the elastic layer deforms, the elastic layer absorbs slight surface asperities of the fixing belt 21, preventing formation of the faulty orange peel image.

A detailed description is now given of a configuration of the stay 27.

The stay 27 serving as a support that supports the nip formation pad 26 is situated inside the loop formed by the fixing belt 21. As the nip formation pad 26 receives pressure from the pressure roller 22, the stay 27 supports the nip formation pad 26 to prevent bending of the nip formation pad 26 and produce a predetermined nip length in the sheet conveyance direction A1 throughout the entire width of the fixing belt 21 in an axial direction thereof parallel to a longitudinal direction of the nip formation pad 26. The stay 27 is made of metal to attain rigidity. The stay 27 is mounted on side plates at both lateral ends of the stay 27 in a longitudinal direction thereof parallel to the axial direction of the fixing belt 21, respectively, thus being positioned inside the fixing device 20. Since the nip formation pad 26 has a complex shape, the nip formation pad 26 is made of heat resistant resin and manufactured by injection molding. For example, the heat resistant resin may be liquid crystal polymer (LCP) having a heat resistant temperature of about 330 degrees centigrade, polyetherketone (PEK) having a heat resistant temperature of about 350 degrees centigrade, or the like. The reflector 29 interposed between the halogen heater 23 and the stay 27 reflects light radiated from the halogen heater 23 to the reflector 29 toward the fixing belt 21, preventing the stay 27 from being heated by the halogen heater 23 and thereby reducing waste of energy.

Alternatively, instead of the reflector 29, an opposed face of the stay 27 disposed opposite the halogen heater 23 may be treated with insulation or mirror finish to reflect light radiated from the halogen heater 23 to the stay 27 toward the fixing belt 21. Instead of the halogen heater 23, an induction heater (IH) having an IH coil may be employed as a heater for heating the fixing belt 21. For example, a driver moves a heat shield to change a heat generation span of the induction heater in a longitudinal direction thereof according to the size of the sheet P, suppressing overheating of a non-conveyance span of the fixing belt 21 where the sheet P is not conveyed. However, the fixing device 20 according to this exemplary embodiment suppresses overheating of the non-conveyance span of the fixing belt 21 without the driver by using thermal conductivity of the material as described below. Alternatively, the heater for heating the fixing belt 21 may be a resistance heat generator, a carbon heater, or the like.

A detailed description is now given of a construction of the pressure roller 22.

The pressure roller 22 is constructed of a metal core 22*a*, an elastic rubber layer 22*b* coating the metal core 22*a*, and a surface release layer 22*c* coating the elastic rubber layer 22*b* and made of PFA or PTFE to facilitate separation of the sheet P from the pressure roller 22. As a driving force generated by a driver (e.g., a motor) situated inside the image forming apparatus 1 depicted in FIG. 1 is transmitted to the pressure roller 22 through a gear train, the pressure roller 22 rotates in the rotation direction R4. A spring presses the pressure roller 22 against the nip formation pad 26 via the fixing belt 21. As the spring presses and deforms the elastic rubber layer 22*b* of the pressure roller 22, the pressure roller 22 produces the fixing nip N having a predetermined length in the sheet conveyance direction A1.

The pressure roller 22 may be a hollow roller or a solid roller. If the pressure roller 22 is a hollow roller, a heater such as a halogen heater may be disposed inside the hollow roller. The elastic rubber layer 22*b* may be made of solid rubber. Alternatively, if no heater is situated inside the pressure roller 22, the elastic rubber layer 22*b* may be made of sponge rubber. The sponge rubber is more preferable than the solid rubber because it has an increased insulation that draws less heat from the fixing belt 21.

As the pressure roller 22 rotates in the rotation direction R4, the fixing belt 21 rotates in the rotation direction R3 in accordance with rotation of the pressure roller 22 by friction therebetween. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21. At the fixing nip N, the fixing belt 21 rotates as it is sandwiched between the pressure roller 22 and the nip formation pad 26; at a circumferential span of the fixing belt 21 other than the fixing nip N, the fixing belt 21 rotates as it is guided by a flange at each lateral end of the fixing belt 21 in the axial direction thereof. As the sheet P is conveyed through the fixing nip N, the fixing belt 21 and the pressure roller 22 apply heat and pressure to the sheet P, fixing the toner image on the sheet P.

With the construction described above, the fixing device 20 attaining quick warm-up is manufactured at reduced costs.

A bulge 28 projects from a downstream end of the nip formation pad 26 in the sheet conveyance direction A1, that is, an exit of the fixing nip N, toward the pressure roller 22. The bulge 28 does not press against the pressure roller 22 via the fixing belt 21 and therefore is not produced by contact with the pressure roller 22. The bulge 28 lifts the sheet P conveyed through the exit of the fixing nip N from the fixing belt 21, facilitating separation of the sheet P from the fixing belt 21.

Figure 3:
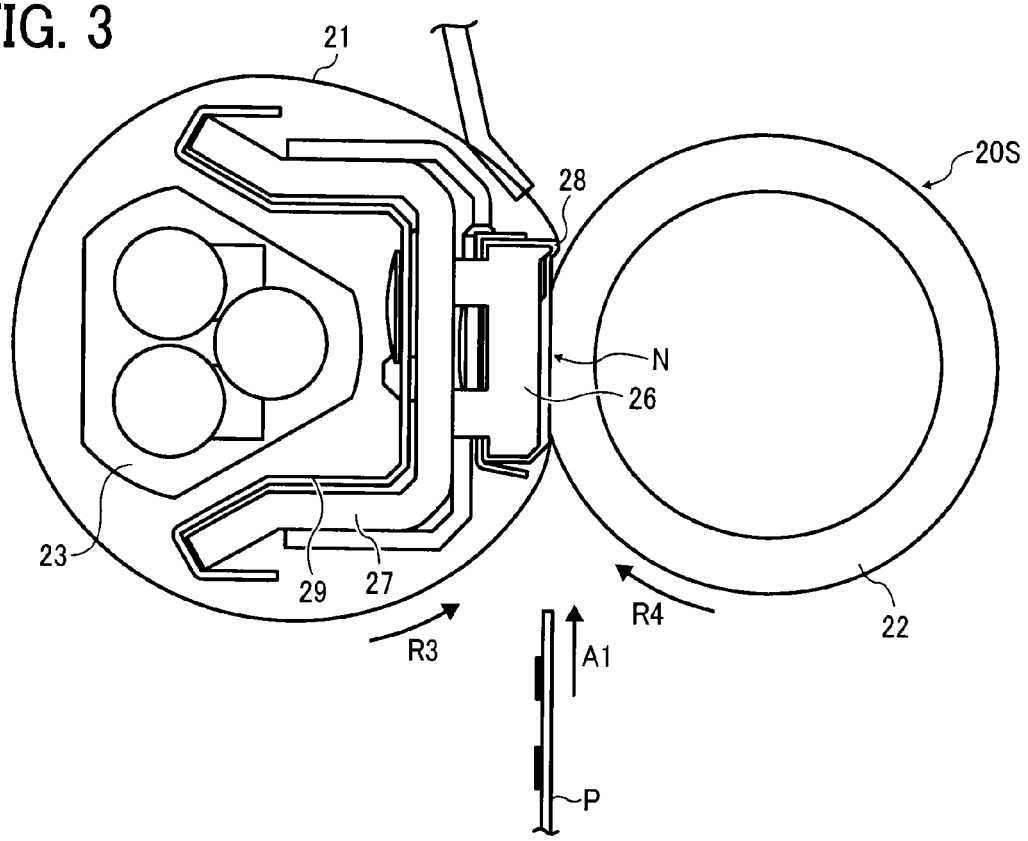
FIG. 3 is a schematic vertical sectional view of a fixing device incorporating three halogen heaters installable in the image forming apparatus shown in FIG. 1.

With reference to FIG. 3, a description is provided of a construction of a fixing device 20S installable in the image forming apparatus 1 depicted in FIG. 1.

FIG. 3 is a schematic vertical sectional view of the fixing device 20S. Unlike the fixing device 20 shown in FIG. 2 that includes the single halogen heater 23, the fixing device 20S shown in FIG. 3 includes three halogen heaters 23 that serve as a heater for heating the fixing belt 21. Other components of the fixing device 20S are substantially equivalent to those of the fixing device 20. Hence, identical reference numerals are assigned to the components of the fixing device 20S equivalent to those of the fixing device 20 and redundant description is omitted. With the increased number of the halogen heaters 23, the fixing device 20S performs fixing on sheets P of various sizes while maintaining productivity. Like the fixing device 20 shown in FIG. 2, the fixing device 20S shown in FIG. 3 includes the bulge 28 projecting from the downstream end of the nip formation pad 26 in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

Figure 4:
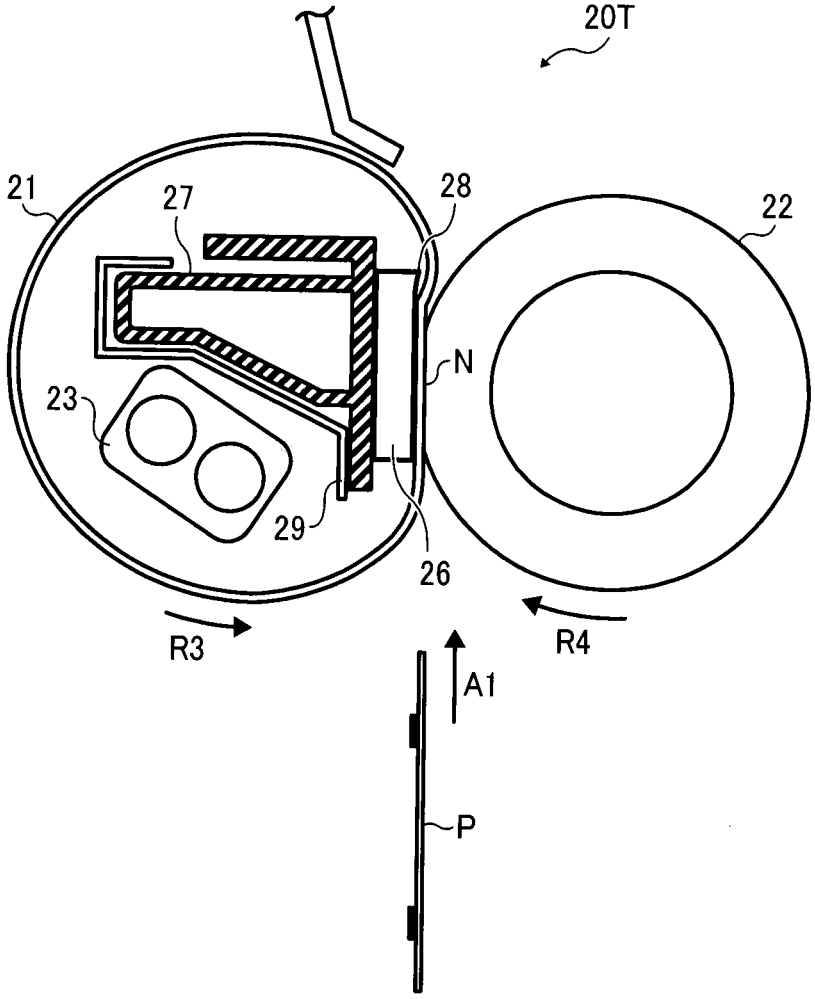
FIG. 4 is a schematic vertical sectional view of a fixing device incorporating two halogen heaters installable in the image forming apparatus shown in FIG. 1.

With reference to FIG. 4, a description is provided of a construction of a fixing device 20T installable in the image forming apparatus 1 depicted in FIG. 1.

FIG. 4 is a schematic vertical sectional view of the fixing device 20T. Unlike the fixing device 20 shown in FIG. 2 that includes the single halogen heater 23, the fixing device 20T shown in FIG. 4 includes two halogen heaters 23 that serve as a heater for heating the fixing belt 21. Like the fixing device 20 shown in FIG. 2, the fixing device 20T shown in FIG. 4 includes the bulge 28 projecting from the downstream end of the nip formation pad 26 in proximity to the exit of the fixing nip N toward the pressure roller 22. The bulge 28 does not press against the pressure roller 22 via the fixing belt 21 and therefore is not produced by contact with the pressure roller 22. The bulge 28 facilitates separation of a sheet P from the fixing belt 21.

A description is provided of overheating of the fixing belt 21.

The halogen heaters 23 installed in the fixing devices 20, 20S, and 20T heat the fixing belt 21 in a heat generation span corresponding to a width of a maximum sheet P in the axial direction of the fixing belt 21 available in the image forming apparatus 1 depicted in FIG. 1.

As a plurality of small sheets P having a width smaller than the heat generation span of the halogen heaters 23 is conveyed over the fixing belt 21 in a conveyance span thereof continuously, a non-conveyance span of the fixing belt 21 outboard from the conveyance span in the axial direction of the fixing belt 21 where the small sheets P are not conveyed may overheat substantially to a temperature above a heat resistant temperature of the fixing belt 21 because the small sheets P do not draw heat from the non-conveyance span of the fixing belt 21. For example, if the fixing devices 20, 20S, and 20T are installed in the image forming apparatus 1 capable of conveying a maximum sheet P, that is, an A3 size sheet in portrait orientation, as small sheets P, for example, A6 size postcards, are conveyed over the fixing belt 21 continuously, the non-conveyance span of the fixing belt 21 where the small sheets P are not conveyed may overheat. To address this circumstance, the small sheets P are conveyed over the fixing belt 21 at an increased interval between the consecutive sheets P before the temperature of the non-conveyance span of the fixing belt 21 reaches a dangerous temperature, cooling the fixing belt 21 and thereby avoiding a risk of overheating of the fixing belt 21. However, cooling the fixing belt 21 may decrease productivity of the image forming apparatus 1. For example, if the image forming apparatus 1 features high speed printing, degradation in productivity may be a substantial disadvantage. Accordingly, it is requested to prevent the non-conveyance span of the fixing belt 21 from exceeding the dangerous temperature without degrading productivity of the image forming apparatus 1.

As shown in FIGS. 2 to 4, the fixing belt 21 has a decreased thermal capacity to shorten a warm-up time taken to heat the fixing belt 21 to a desired fixing temperature and save energy. Hence, the fixing belt 21 is susceptible to temperature change and the dangerous temperature.

In order to suppress overheating of the fixing belt 21 in the non-conveyance span thereof, that is, each lateral end in the axial direction of the fixing belt 21, which may occur after the plurality of small sheets P having the width smaller than the heat generation span of the halogen heaters 23 is conveyed over the fixing belt 21 continuously, heat may be dissipated from the fixing belt 21 by using the nip formation pad 26 disposed opposite the fixing belt 21. For example, if the halogen heaters 23 are located inside the fixing belt 21, the halogen heaters 23 may also heat peripheral components such as the stay 27 that may obstruct thermal dissipation of the nip formation pad 26.

As described above, when the plurality of small sheets P having the width smaller than the heat generation span of the halogen heaters 23 is conveyed over the fixing belt 21 in the conveyance span thereof continuously, the non-conveyance span of the fixing belt 21 outboard from the conveyance span in the axial direction of the fixing belt 21 where the small sheets P are not conveyed may overheat substantially to a temperature above the heat resistant temperature of the fixing belt 21 because the small sheets P do not draw heat from the non-conveyance span of the fixing belt 21. For example, in the image forming apparatus 1 capable of high speed printing, the sheet P is conveyed at a conveyance speed higher than a thermal conduction speed at which heat is conducted in the nip formation pad 26 in the longitudinal direction thereof. Accordingly, an amount of heat input to the fixing belt 21 and an amount of heat output from the fixing belt 21 increase per unit time, resulting in substantial overheating of each lateral end of the fixing belt 21 in the axial direction thereof. Similarly, the stay 27 situated inside the loop formed by the fixing belt 21 is susceptible to heat from the halogen heaters 23 for an increased time.

To address those circumstances, the nip formation pad 26 according to this exemplary embodiment is configured as described below to prevent overheating of the fixing belt 21 in each lateral end in the axial direction thereof.

Figure 5:
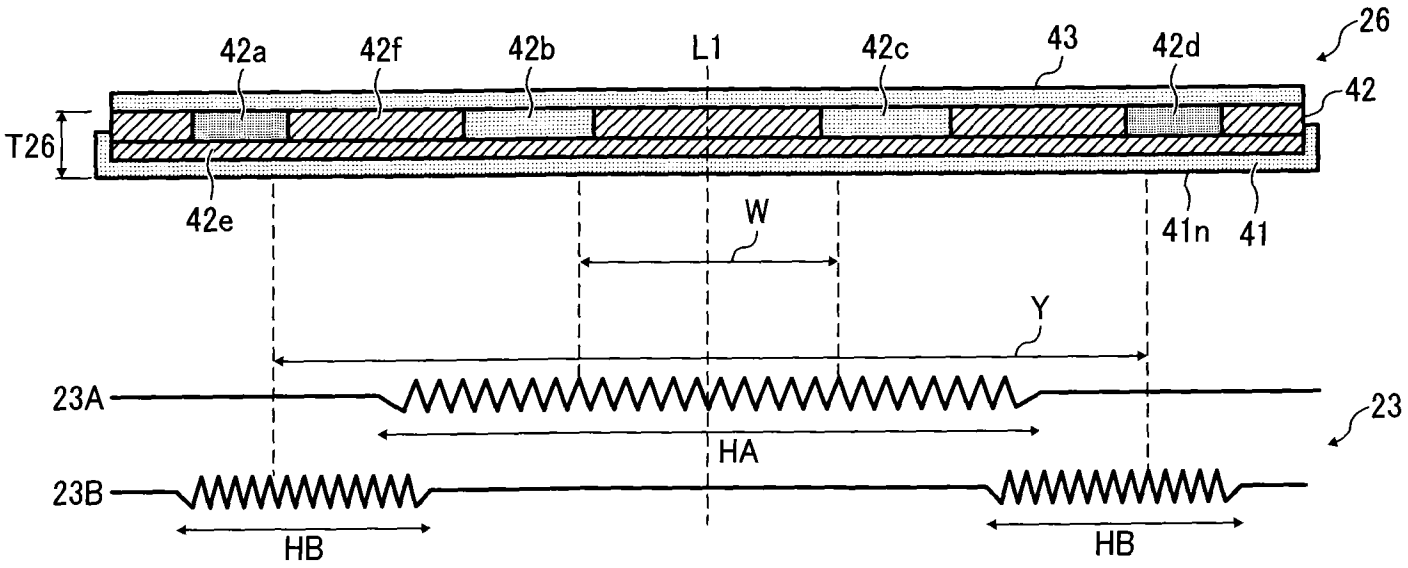
FIG. 5 is a schematic horizontal sectional view of a nip formation pad and the two halogen heaters incorporated in the fixing device shown in FIG. 4.

With reference to FIG. 5, a description is provided of a configuration of the nip formation pad 26 as one example.

FIG. 5 is a schematic horizontal sectional view of the nip formation pad 26 and the halogen heaters 23 incorporated in the fixing device 20T depicted in FIG. 4. As shown in FIG. 5, the nip formation pad 26 is constructed of three layers: a nip side layer 41 disposed opposite the pressure roller 22, a support side layer 43 contacting the stay 27, and an intermediate layer 42 sandwiched between the nip side layer 41 and the support side layer 43.

A detailed description is now given of a configuration of the nip side layer 41.

The nip side layer 41 includes an increased thermal conductivity conductor extending throughout the entire width of the nip formation pad 26 in the longitudinal direction thereof with an even thickness. The nip side layer 41 is made of a material having an increased thermal conductivity and a decreased thermal capacity described below. For example, the nip side layer 41 is a plate having a thickness in a range of from about 0.2 mm to about 1.0 mm and made of copper, aluminum, or the like, thus having a desired thermal conductivity and being manufactured at reduced costs.

The fixing belt 21 is heated by the halogen heaters 23 quickly and heat is conducted from the fixing belt 21 to the nip formation pad 26 as the heated fixing belt 21 contacts the nip formation pad 26. If the fixing belt 21 has a decreased thermal conductivity, the fixing belt 21 is susceptible to uneven temperature in the axial direction thereof. Since the fixing belt 21 has a decreased thermal capacity and a decreased thermal conductivity, the fixing belt 21 is susceptible to variation in temperature in the axial direction thereof. However, it is desirable to reduce variation in temperature of the fixing belt 21 to even fixing property and gloss of the toner image fixed on the sheet P so as to form the high quality toner image.

If the inner circumferential surface of the fixing belt 21 is configured to slide over the nip side layer 41 of the nip formation pad 26 directly, the fixing belt 21 and the nip formation pad 26 may produce a relatively high friction coefficient μ that causes insufficient durability against abrasion of the fixing belt 21 and the nip formation pad 26. To address this circumstance, a nip face 41*n* of the nip side layer 41 that contacts the fixing belt 21 is coated with PTFE or PFA having a decreased friction coefficient or finished with coating or a PTFE or PFA sheet is sandwiched between the nip side layer 41 and the fixing belt 21. Alternatively, the nip face 41*n* of the nip side layer 41 may be coated with a slide sheet manufactured by weaving PTFE or PFA fiber into fabric. Fluorine or silicone grease or oil may be applied to the nip face 41*n* of the nip side layer 41 as a lubricant that reduces the friction coefficient μ. The materials described above that reduce the friction coefficient μ have an increased thermal conductivity.

A detailed description is now given of a configuration of the intermediate layer 42.

The intermediate layer 42 is a multi-conductivity layer constructed of increased thermal conductivity conductors 42*a*, 42*b*, 42*c*, and 42*d* indicated by dotted hatching and decreased thermal conductivity conductors 42*e* and 42*f* indicated by slashed hatching. The decreased thermal conductivity conductor 42*e* contacts the nip side layer 41 and extends throughout the entire width of the nip formation pad 26 in the longitudinal direction thereof. The decreased thermal conductivity conductor 42*e* has an even thickness throughout the entire width of the nip formation pad 26 in the longitudinal direction thereof. The increased thermal conductivity conductors 42*a*, 42*b*, 42*c*, and 42*d* and the decreased thermal conductivity conductors 42*f* are in contact with the support side layer 43 and arranged such that the decreased thermal conductivity conductors 42*f* sandwich each of the increased thermal conductivity conductors 42*a*, 42*b*, 42*c*, and 42*d* in the longitudinal direction of the nip formation pad 26. The increased thermal conductivity conductors 42*a*, 42*b*, 42*c*, and 42*d* are disposed opposite an overheating span of the fixing belt 21 in the axial direction thereof situated in a non-conveyance span of the fixing belt 21 where sheets P of sizes other than a maximum size available in the image forming apparatus 1 are not conveyed. Conversely, the decreased thermal conductivity conductors 42*f* are outboard or inboard from the increased thermal conductivity conductors 42*a*, 42*b*, 42*c*, and 42*d* in the axial direction of the fixing belt 21, respectively.

For example, if an A3 size sheet is available as a maximum sheet, the increased thermal conductivity conductors 42*a* and 42*d* are disposed opposite both lateral ends of a B4 size sheet in portrait orientation having a width Y in the axial direction of the fixing belt 21, respectively; the increased thermal conductivity conductors 42*b* and 42*c* are disposed opposite both lateral ends of a postcard size sheet having a width W in the axial direction of the fixing belt 21, respectively. The arrangement that the decreased thermal conductivity conductors 42*f* sandwich each of the increased thermal conductivity conductors 42*a*, 42*b*, 42*c*, and 42*d* in the longitudinal direction of the nip formation pad 26 may be repeated in a thickness direction T26 of the nip formation pad 26 such that the intermediate layer 42 includes a plurality of layers each of which is constructed of the increased thermal conductivity conductors 42*a*, 42*b*, 42*c*, and 42*d* and the decreased thermal conductivity conductors 42*f*.

The intermediate layer 42 includes the increased thermal conductivity conductors 42*a*, 42*b*, 42*c*, and 42*d* disposed at a plurality of positions in the longitudinal direction of the nip formation pad 26, that is, the outboard, increased thermal conductivity conductors 42*a* and 42*d* and the inboard, increased thermal conductivity conductors 42*b* and 42*c*. However, the outboard, increased thermal conductivity conductors 42*a* and 42*d* or the inboard, increased thermal conductivity conductors 42*b* and 42*c* may be omitted according to the size of the sheet P and the length of the halogen heaters 23. For example, if the fixing device 20T includes the plurality of halogen heaters 23 having different heat generation spans in a longitudinal direction thereof parallel to the axial direction of the fixing belt 21 as shown in FIG. 5, the number of the halogen heaters 23 to be turned on may be changed according to the size of the sheet P.

As shown in FIG. 5, the halogen heaters 23 include a halogen heater 23A having a heat generation span HA and a halogen heater 23B having a heat generation span HB in the longitudinal direction of the halogen heaters 23. When the B4 size sheet having the width Y is conveyed over the fixing belt 21, if the halogen heater 23A is turned on, the halogen heater 23A having the heat generation span HA does not heat the entire width Y of the B4 size sheet. To address this circumstance, in addition to the halogen heater 23A, the halogen heater 23B is also turned on to heat the B4 size sheet throughout the entire width Y with a combined heat generation span combining the heat generation span HA of the halogen heater 23A and the heat generation spans HB of the halogen heater 23B. However, since the heat generation span HB of the halogen heater 23B is partially outboard from the width Y of the B4 size sheet, the halogen heater 23B heats a non-conveyance span of the fixing belt 21 outboard from the width Y of the B4 size sheet. The B4 size sheet does not draw heat from the non-conveyance span of the fixing belt 21 outboard from the width Y of the B4 size sheet, causing overheating of the fixing belt 21.

To prevent overheating of the fixing belt 21, the increased thermal conductivity conductors 42*a* and 42*d* are disposed opposite the non-conveyance span of the fixing belt 21 where the B4 size sheet is not conveyed and both lateral ends of the B4 size sheet in the axial direction of the fixing belt 21. The material of the outboard, increased thermal conductivity conductors 42*a* and 42*d* may be equivalent to or different from the material of the inboard, increased thermal conductivity conductors 42*b* and 42*c*. For example, the increased thermal conductivity conductors 42*a*, 42*b*, 42*c*, and 42*d* are made of copper or aluminum. FIG. 5 illustrates the outboard, increased thermal conductivity conductors 42*a* and 42*d* with dotted hatching different from that of the inboard, increased thermal conductivity conductors 42*b* and 42*c* to suggest that the material of the outboard, increased thermal conductivity conductors 42*a* and 42*d* may be different from the material of the inboard, increased thermal conductivity conductors 42*b* and 42*c*.

The thickness of the outboard, increased thermal conductivity conductors 42*a* and 42*d* vertically extending in FIG. 5 in the thickness direction T26 may be equivalent to or different from that of the inboard, increased thermal conductivity conductors 42*b* and 42*c*. The material and thickness of the increased thermal conductivity conductors 42*a*, 42*b*, 42*c*, and 42*d* are determined according to an amount of energy input from the halogen heaters 23A and 23B.

Incidentally, the intermediate layer 42 may be constructed of the increased thermal conductivity conductors 42*a*, 42*b*, 42*c*, and 42*d* and the decreased thermal conductivity conductors 42*f* sandwiching each of the increased thermal conductivity conductors 42*a*, 42*b*, 42*c*, and 42*d* in the longitudinal direction of the nip formation pad 26. However, in this case, the increased thermal conductivity conductors 42*a*, 42*b*, 42*c*, and 42*d* having an increased thermal conductivity may absorb heat from the fixing belt 21 in an increased amount while the decreased thermal conductivity conductors 42*f* having a decreased thermal conductivity may absorb heat from the fixing belt 21 in a decreased amount, causing substantial temperature variation of the fixing belt 21 in the axial direction thereof. Accordingly, a portion of the fixing belt 21 that suffers from substantial temperature decrease does not reach a desired fixing temperature, causing faulty fixing resulting in formation of a faulty toner image.

To address this circumstance, the intermediate layer 42 includes the elongate, decreased thermal conductivity conductor 42*e* extending throughout the entire width of the nip formation pad 26 in the longitudinal direction thereof and contacting the nip side layer 41, preventing substantial temperature variation of the fixing belt 21 in the axial direction thereof. The heat resistant, decreased thermal conductivity conductor 42*e* allows change in thickness of the increased thermal conductivity conductors 42*a*, 42*b*, 42*c*, and 42*d* and change in thickness of the decreased thermal conductivity conductor 42*e* defining a distance from the nip side layer 41 to the increased thermal conductivity conductors 42*a*, 42*b*, 42*c*, and 42*d* in the thickness direction T26 of the nip formation pad 26.

If the thickness of the decreased thermal conductivity conductors 42*e* and 42*f* is small, heat absorbed from the fixing belt 21 is conducted to the increased thermal conductivity conductors 42*a*, 42*b*, 42*c*, and 42*d* quickly. Conversely, if the thickness of the decreased thermal conductivity conductors 42*e* and 42*f* is great, heat absorbed from the fixing belt 21 is conducted to the increased thermal conductivity conductors 42*a*, 42*b*, 42*c*, and 42*d* slowly. Using such heat conduction, the amount of heat absorbed from the fixing belt 21 and the time taken to conduct heat absorbed from the fixing belt 21 are adjusted by changing the thickness of the decreased thermal conductivity conductors 42*e* and 42*f*. The thickness of the decreased thermal conductivity conductors 42*e* and 42*f* is determined according to an amount of energy input from the halogen heaters 23A and 23B.

As shown in FIG. 5, the intermediate layer 42 includes a first layer constructed of the decreased thermal conductivity conductor 42*e* and a second layer layered on the first layer and constructed of the increased thermal conductivity conductors 42*a*, 42*b*, 42*c*, and 42*d* and the decreased thermal conductivity conductors 42*f* sandwiching each of the increased thermal conductivity conductors 42*a*, 42*b*, 42*c*, and 42*d*. Alternatively, the increased thermal conductivity conductors 42*a*, 42*b*, 42*c*, and 42*d* may be embedded in an integration layer produced by integration of the decreased thermal conductivity conductors 42*e* and 42*f*. For example, the increased thermal conductivity conductors 42*a*, 42*b*, 42*c*, and 42*d* may be embedded in recesses produced in the single decreased thermal conductivity conductor 42*e*, respectively.

The nip formation pad 26 includes the support side layer 43, having an increased thermal conductivity, disposed opposite the nip side layer 41 via the intermediate layer 42 at an upper part of the nip formation pad 26 in FIG. 5. The support side layer 43 absorbs heat conducted from the overheated fixing belt 21 through the nip side layer 41, the decreased thermal conductivity conductors 42*e* and 42*f*, and the increased thermal conductivity conductors 42*a*, 42*b*, 42*c*, and 42*d*. Hence, the highly conductive, support side layer 43 contacts the increased thermal conductivity conductors 42*a*, 42*b*, 42*c*, and 42*d*.

The increased thermal conductivity conductors 42*a*, 42*b*, 42*c*, and 42*d* do not extend throughout the entire width of the nip formation pad 26 in the longitudinal direction thereof but extend in a part of the nip formation pad 26 in the longitudinal direction thereof. Accordingly, the increased thermal conductivity conductors 42*a*, 42*b*, 42*c*, and 42*d* may have insufficient thermal capacity and therefore may absorb heat from the overheated fixing belt 21 insufficiently. To address this circumstance, a component that has an increased thermal capacity to absorb heat quickly and barely suffer from temperature saturation and an increased thermal conductivity, that is, the support side layer 43, is needed. The support side layer 43 is made of copper, aluminum, or the like. As the thermal conductivity of the support side layer 43 increases, the support side layer 43 attains its advantage more precisely.

The nip formation pad 26 according to this exemplary embodiment employs an increased thermal conductivity material as the nip side layer 41, the support side layer 43, and a part of the intermediate layer 42 and a decreased thermal conductivity material as another part of the intermediate layer 42. For example, the nip formation pad 26 employs materials shown below in Tables 1 and 2.

Table 1 below shows examples of the increased thermal conductivity material.

TABLE 1

| Material | Thermal conductivity (W/mK) |
|---|---|
| Carbon nanotube | 3,000 to 5,500 |
| Graphite sheet | 700 to 1,750 |
| Silver | 420 |
| Copper | 398 |
| Aluminum | 236 |

Table 2 below shows examples of the decreased thermal conductivity material.

TABLE 2

| Material (heat resistant resin) | Thermal conductivity (W/mK) |
|---|---|
| Polyphenylene sulfide (PPS) | 0.20 |
| Polyamide imide (PAI) | 0.29 to 0.60 |
| Polyether ether ketone (PEEK) | 0.26 |
| Polyetherketone (PEK) | 0.29 |
| Liquid crystal polymer (LCP) | 0.38 to 0.56 |

Since the nip formation pad 26 is disposed opposite the inner circumferential surface of the fixing belt 21, as the fixing belt 21 rotates in the rotation direction R3, the inner circumferential surface of the fixing belt 21 contacts and slides over the nip formation pad 26. Since the nip formation pad 26 is constantly exerted with predetermined pressure or more from the pressure roller 22 via the fixing belt 21, the nip formation pad 26 adheres to the fixing belt 21 sufficiently and receives heat from the fixing belt 21 readily.

The nip formation pad 26 has a total thickness in a range of from about 1 mm to about 10 mm that increases the cross-sectional area of the nip formation pad 26, thus increasing an amount of heat conducted in the longitudinal direction of the nip formation pad 26.

In order to prioritize equalization of heat in the axial direction of the fixing belt 21, the surface of the nip formation pad 26 is made of a highly conductive material and the nip face 41*n* of the nip side layer 41 of the nip formation pad 26 has a smooth surface with a surface roughness not greater than that of the inner circumferential surface of the fixing belt 21, thus facilitating adhesion of the nip formation pad 26 to the fixing belt 21. If surface asperities of the nip formation pad 26 produce a space between the nip formation pad 26 and the fixing belt 21, air in the space may insulate the nip formation pad 26 from the fixing belt 21, obstructing conduction of heat from the fixing belt 21 to the nip formation pad 26 substantially. To prevent this, the nip face 41*n* of the nip side layer 41 of the nip formation pad 26 has the smooth surface.

Alternatively, the nip face 41*n* of the nip side layer 41 of the nip formation pad 26 that contacts the fixing belt 21 may be coated with fluoroplastic, such as PFA, PTFE, and ethylene tetrafluoroethylene (ETFE), having a thickness in a range of from about 5 micrometers to about 50 micrometers to facilitate sliding of the fixing belt 21 over the nip formation pad 26. However, since the thermal conductivity of the fluoroplastic is smaller than that of the increased thermal conductivity material described above, the thickness and employment of the fluoroplastic may be determined properly. Yet alternatively, in order to facilitate sliding of the fixing belt 21 over the nip formation pad 26 further, the nip face 41*n* of the nip side layer 41 of the nip formation pad 26 may be applied with a lubricant such as silicone oil, silicone grease, and fluorine grease. In order to facilitate sliding of the fixing belt 21 over the nip formation pad 26 further, the nip face 41*n* of the nip side layer 41 of the nip formation pad 26 may be coated with a slide sheet manufactured by weaving PTFE or PFA fiber into a sheet. Alternatively, the slide sheet may be manufactured by coating a thin resin base with PFA or PTFE or by braiding glass cloth into a base.

The decreased thermal conductivity conductors 42*e* and 42*f* of the nip formation pad 26 are made of heat resistant resin having an increased thermal resistance and a sufficient mechanical strength against pressure from the pressure roller 22 even under high temperature. For example, the decreased thermal conductivity conductors 42*e* and 42*f* are made of polyphenylene sulfide (PPS), polyether ether ketone (PEEK), PEK, polyamide imide (PAD, and LCP.

As described above, the nip formation pad 26 evens the temperature of the fixing belt 21 in the axial direction thereof, protecting the fixing belt 21 from thermal degradation and preventing local temperature variation of the fixing belt 21 that may result in formation of a faulty toner image.

In order to attain the advantages described above, the nip formation pad 26 selectively conducts heat quickly from the nip side layer 41 to the support side layer 43 disposed opposite the nip side layer 41 via the intermediate layer 42. However, if the intermediate layer 42 incorporating the increased thermal conductivity conductors 42*a*, 42*b*, 42*c*, and 42*d* does not incorporate the decreased thermal conductivity conductor 42*e*, the fixing belt 21 may suffer from sharp temperature decrease as described above.

As shown in FIG. 3, the fixing device 20S includes the halogen heaters 23 serving as a heater disposed inside the loop formed by the fixing belt 21 to heat the fixing belt 21. For example, each of the halogen heaters 23 includes a glass tube filled with halogen gas and a tungsten lamp disposed inside the glass tube. As the tungsten lamp is supplied with power, the tungsten lamp generates Joule heat. Since the halogen heater 23 radiates heat omnidirectionally, as the halogen heater 23 heats the fixing belt 21, it also heats the stay 27 with heat radiated in a circumferential span defined between an 11 o'clock position and a 7 o'clock position in FIG. 3. Accordingly, the halogen heaters 23 may heat the fixing belt 21 ineffectively.

To address this circumstance, the reflector 29 is interposed between the halogen heaters 23 and the stay 27 to reflect light radiated from the halogen heaters 23 to the stay 27 toward the fixing belt 21, thus enhancing heat radiation efficiency of the halogen heaters 23 to the fixing belt 21. For example, the reflector 29 is a reflection plate constructed of an aluminum base treated with vacuum deposition of high purity aluminum on a surface thereof and an oxide film coating the base by deposition to enhance reflection. However, since the reflector 29 does not achieve an infrared reflectance of 100 percent, the halogen heaters 23 may heat the stay 27, increasing the temperature of the stay 27 gradually. Since the stay 27 is requested to have a mechanical strength and a rigidity great enough to support the nip formation pad 26 against load imposed by the pressure roller 22, the stay 27 is manufactured by bending steel, for example, steel, electro-galvanized, cold-rolled, coil (SECC), that is, a zinc coated steel plate. The stay 27 contacts the nip formation pad 26 directly to support the nip formation pad 26 against load from the pressure roller 22.

When the temperature of the stay 27 exceeds the temperature of the support side layer 43 of the nip formation pad 26, heat conduction from the nip side layer 41 to the support side layer 43, that is, the heat conduction velocity at which heat is conducted from the nip side layer 41 to the support side layer 43, degrades as obvious from Fourier's law.

To address this circumstance, in order to attain temperature difference between the temperature of the support side layer 43 and the temperature of the stay 27 that is lower than the temperature of the support side layer 43, a thermal conductivity of the support side layer 43 is greater than that of the stay 27. Accordingly, degradation in thermal conduction from the nip side layer 41 to the support side layer 43 is prevented, facilitating quick thermal conduction from the nip side layer 41 to the support side layer 43. In an experiment in which sheets P were conveyed over the fixing belt 21 under a condition that might cause overheating of the fixing belt 21 in both lateral ends in the axial direction thereof, the fixing belt 21 was heated to an upper limit temperature within about 120 seconds. In the experiment, the upper limit temperature of the fixing belt 21 was set to 230 degrees centigrade in view of protection of the fixing belt 21. If the reflector 29 is not installed or if the stay 27 is made of an increased thermal conductivity material, the fixing belt 21 may be heated to the upper limit temperature within a substantially decreased time. Thereafter, the image forming apparatus 1 cannot perform an image forming operation until the fixing belt 21 is cooled or a print speed, that is, the number of prints per unit time, may decrease.

To address this circumstance, the temperature of an interface between the support side layer 43 of the nip formation pad 26 and the stay 27 is controlled to maintain a relation defining that the temperature of the stay 27 is lower than the temperature of the support side layer 43 for a substantially extended time. Accordingly, even when a plurality of sheets P of a size that may cause overheating of the fixing belt 21 in both lateral ends in the axial direction thereof is conveyed over the fixing belt 21 continuously, the fixing belt 21 is heated to the upper limit temperature after an extended time elapses, allowing the image forming apparatus 1 to continue an image forming operation for the extended time without degradation in productivity of printing at high speed.

Figure 6:
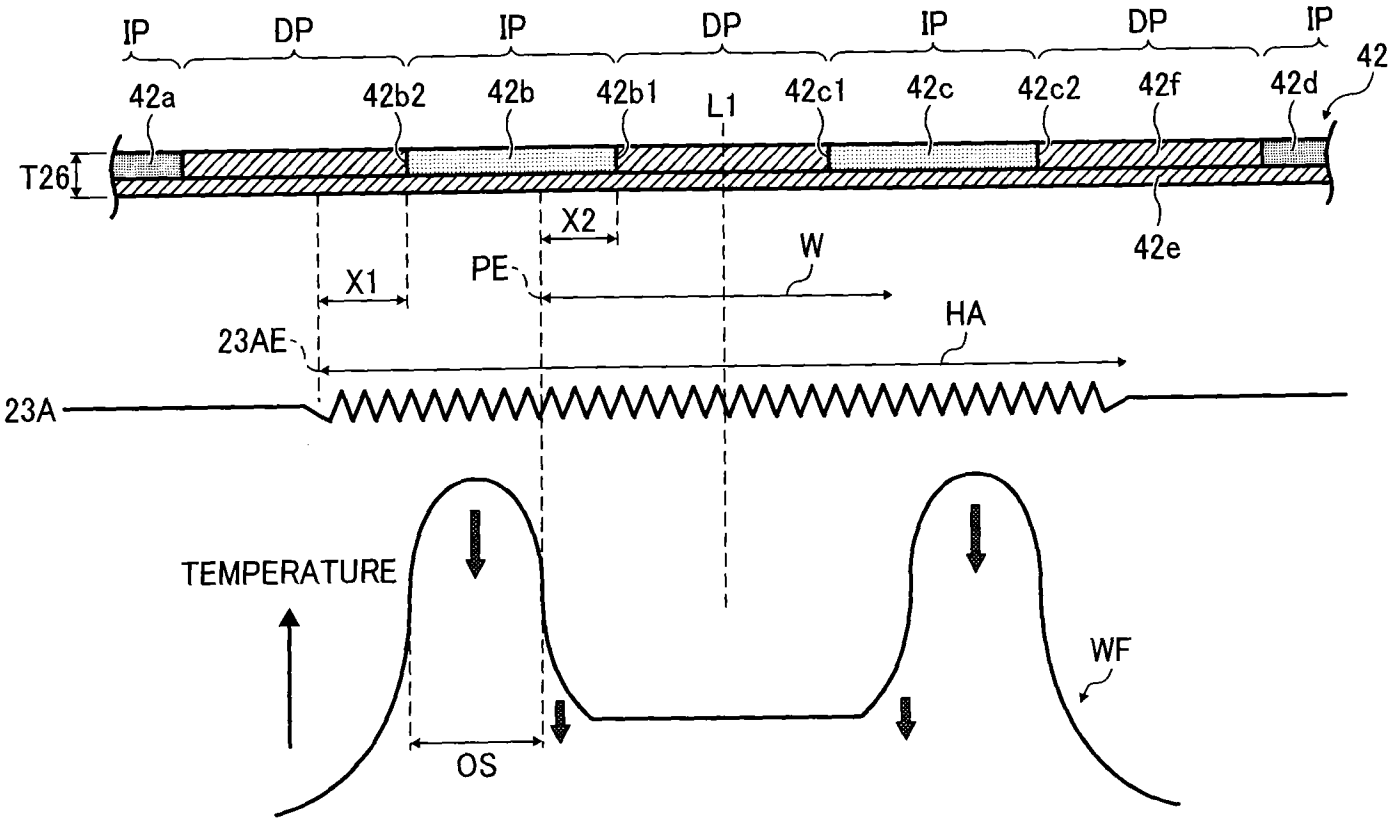
FIG. 6 is a partial horizontal sectional view of an intermediate layer of the nip formation pad and one of the two halogen heaters shown in FIG. 5.

FIG. 6 is a partial horizontal sectional view of the intermediate layer 42 of the nip formation pad 26 and the halogen heater 23A. The increased thermal conductivity conductors 42*a*, 42*b*, 42*c*, and 42*d* are disposed at a part of the intermediate layer 42 in a longitudinal direction thereof parallel to the axial direction of the fixing belt 21, producing an increased thermal conduction portion IP and a decreased thermal conduction portion DP arranged alternately in the longitudinal direction of the intermediate layer 42. The increased thermal conduction portion IP is constructed of a plurality of materials having different thermal conductivities, respectively, layered vertically in FIG. 6 in the thickness direction T26 of the nip formation pad 26. Accordingly, the increased thermal conduction portion IP has a thermal conductivity in total thickness in the thickness direction T26 greater than that of the decreased thermal conduction portion DP. Consequently, the increased thermal conduction portion IP absorbs heat from the fixing belt 21 easily. When the fixing belt 21 overheats substantially at a portion disposed opposite the increased thermal conduction portion IP, for example, an overheating span OS, the increased thermal conduction portion IP absorbs heat from the overheated portion of the fixing belt 21 in the thickness direction T26 of the nip formation pad 26, suppressing overheating of the fixing belt 21.

Taking a small sheet P having the width W, for example, an inboard edge 42*b*1 of the increased thermal conductivity conductor 42*b* is inboard from a lateral edge PE of the small sheet P toward a center line L1 defining a center of the nip formation pad 26 in the longitudinal direction thereof by an axial length X2. The lateral edge PE of the small sheet P defines a boundary between a conveyance span where the small sheet P is conveyed over the fixing belt 21 and a non-conveyance span where the small sheet P is not conveyed over the fixing belt 21. Similarly, an inboard edge 42*c*1 of the increased thermal conductivity conductor 42*c* is inboard from another lateral edge PE of the small sheet P toward the center line L1 in the longitudinal direction of the nip formation pad 26 by the axial length X2. Accordingly, the increased thermal conductivity conductors 42*b* and 42*c* suppress overheating of the fixing belt 21 in an overheating span of the fixing belt 21 disposed opposite each lateral end of the small sheet P in proximity to the lateral edge PE. Consequently, the increased thermal conductivity conductors 42*b* and 42*c* suppress overheating of the fixing belt 21 in the conveyance span thereof where the small sheet P is conveyed that may occur due to heat conduction from the overheated non-conveyance span of the fixing belt 21, thus preventing hot offset of toner of the toner image formed on the small sheet P and resultant formation of a faulty toner image.

The increased thermal conductivity conductors 42*b* and 42*c* are inboard from a lateral edge 23AE of the heat generation span HA of the halogen heater 23A in the axial direction of the fixing belt 21. For example, an outboard edge 42*b*2 of the increased thermal conductivity conductor 42*b* is inboard from the lateral edge 23AE of the heat generation span HA of the halogen heater 23A in the axial direction of the fixing belt 21 by an axial length X1. Similarly, an outboard edge 42*c*2 of the increased thermal conductivity conductor 42*c* is inboard from another lateral edge 23AE of the heat generation span HA of the halogen heater 23A in a longitudinal direction thereof parallel to the axial direction of the fixing belt 21 by the axial length X1.

As shown by a temperature wavelength WF of the fixing belt 21 in FIG. 6, it is difficult for each outermost end of the halogen heater 23A in the longitudinal direction thereof to heat the fixing belt 21 to a desired temperature compared to a center of the halogen heater 23A in the longitudinal direction thereof, decreasing the temperature of each lateral end of the fixing belt 21 in the axial direction thereof. It is because a length of the fixing belt 21 in the axial direction thereof is greater than the heat generation span HA of the halogen heater 23A and heat is conducted from each outermost end of the halogen heater 23A to each lateral end of the fixing belt 21. Accordingly, it is not necessary to locate the increased thermal conductivity conductors 42*b* and 42*c* at positions outboard from the heat generation span HA of the halogen heater 23A in the longitudinal direction thereof. Hence, the outboard edge 42*b*2 of the increased thermal conductivity conductor 42*b* is inboard from the lateral edge 23AE of the heat generation span HA of the halogen heater 23A in the longitudinal direction thereof by the axial length X1. Similarly, the outboard edge 42*c*2 of the increased thermal conductivity conductor 42*c* is inboard from another lateral edge 23AE of the heat generation span HA of the halogen heater 23A in the longitudinal direction thereof by the axial length X1.

If the outboard edge 42*b*2 of the increased thermal conductivity conductor 42*b* is situated outboard from the lateral edge 23AE of the heat generation span HA of the halogen heater 23A in the longitudinal direction thereof and the outboard edge 42*c*2 of the increased thermal conductivity conductor 42*c* is situated outboard from another lateral edge 23AE of the heat generation span HA of the halogen heater 23A in the longitudinal direction thereof, the increased thermal conductivity conductors 42*b* and 42*c* may absorb heat from the fixing belt 21 unnecessarily, wasting energy. Hence, the outboard edge 42*b*2 of the increased thermal conductivity conductor 42*b* and the outboard edge 42*c*2 of the increased thermal conductivity conductor 42*c* are situated at positions where the increased thermal conductivity conductors 42*b* and 42*c* absorb heat from the fixing belt 21 necessarily and sufficiently. The decreased thermal conductivity conductor 42*f* is outboard from the heat generation span HA of the halogen heater 23A in the longitudinal direction thereof, suppressing unnecessary absorption of heat from the fixing belt 21 and therefore saving energy.

With reference to FIGS. 7 to 13, a description is provided of supplemental configurations of the nip formation pad 26 installable in the fixing devices 20, 20S, and 20T.

Figure 7:
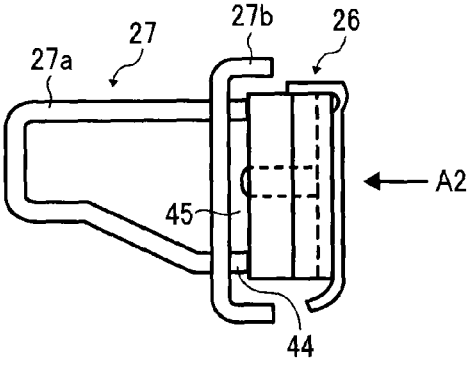
FIG. 7 is a sectional view of the nip formation pad shown in FIG. 5 and a stay incorporated in the fixing device shown in FIG. 4, illustrating projections contacting the nip formation pad.
Figure 8:
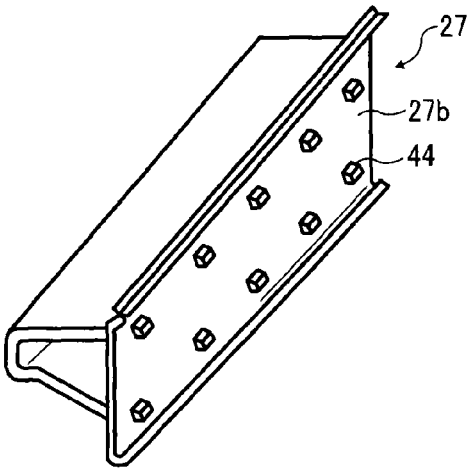
FIG. 8 is a perspective view of the stay shown in FIG. 7.

With reference to FIGS. 7 and 8, a description is provided of a mechanism to increase heat dissipation from the nip formation pad 26.

FIG. 7 is a sectional view of the nip formation pad 26 and the stay 27. FIG. 8 is a perspective view of the stay 27. As shown in FIGS. 7 and 8, the fixing device 20T depicted in FIG. 4 includes a plurality of projections 44 serving as supporting points to support the nip formation pad 26. The projections 44 contact the support side layer 43 of the nip formation pad 26 to receive load imposed on the nip formation pad 26 in a load direction A2. The projections 44 may project from the stay 27 or the support side layer 43 of the nip formation pad 26. The projections 44 reduce heat conduction from the stay 27 to the support side layer 43 and at the same time produce or secure an air layer 45 between the stay 27 and the support side layer 43, facilitating heat dissipation from the support side layer 43. Accordingly, heat is conducted from the nip side layer 41 to the support side layer 43 effectively. If the support side layer 43 is made of copper, for example, processing such as cutting is needed to mount the projections 44 on the support side layer 43, increasing manufacturing costs. To address this circumstance, it is preferable to mount the projections 44 on the stay 27.

As shown in FIG. 7, the stay 27 includes two steel plates, that is, a bent, first portion 27*a* and a substantially planar, second portion 27*b*. Projections mounted on the first portion 27*a* engage through-holes penetrating through the second portion 27*b*, respectively. As shown in FIG. 8, the plurality of projections 44 is arranged on the second portion 27*b* of the stay 27 such that an identical interval or a proper interval is provided between the adjacent projections 44 in the longitudinal direction of the stay 27. As the number of the projections 44 and the area where the projections 44 contact the nip formation pad 26 increase, heat is conducted quickly. Since the nip formation pad 26 is supported at both lateral ends in the longitudinal direction thereof, as it receives load from the pressure roller 22, the nip formation pad 26, together with the stay 27, is bent or deformed slightly. To address this circumstance, the shape, the size, and the number of the projections 44 are determined in view of heat conduction and deformation of the nip formation pad 26 and the stay 27 described above.

Figure 9A:
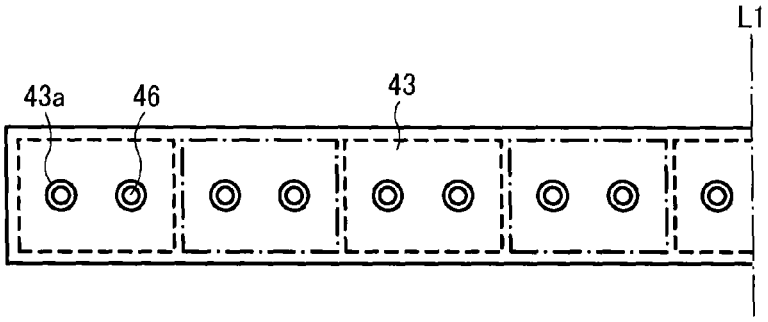
FIG. 9A is a partial plan view of a support side layer of the nip formation pad shown in FIG. 5.
Figure 9B:
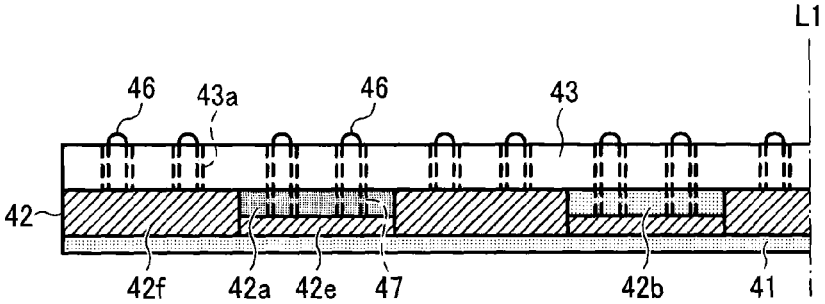
FIG. 9B is a partial sectional view of the support side layer, the intermediate layer, and a nip side layer of the nip formation pad shown in FIG. 5.

With reference to FIGS. 9A and 9B, a description is provided of another mechanism to increase heat dissipation from the nip formation pad 26.

FIG. 9A is a partial plan view of the support side layer 43 of the nip formation pad 26. FIG. 9B is a partial sectional view of the support side layer 43, the intermediate layer 42, and the nip side layer 41 of the nip formation pad 26. As shown in FIGS. 9A and 9B, a plurality of through-holes 43*a* penetrates through the support side layer 43 to increase the surface area of the support side layer 43 and thereby enhance heat dissipation from the support side layer 43. Since the through-holes 43*a* decrease the thermal capacity of the support side layer 43, an upper limit temperature of the overheated lateral ends of the fixing belt 21 in the axial direction thereof after a plurality of sheets P is conveyed over the fixing belt 21 continuously is determined based on the thermal capacity and heat dissipation of the support side layer 43. By determining the number and the shape of the through-holes 43*a* to enhance heat dissipation from the support side layer 43, it is possible to extend the time taken before productivity (e.g., copies per minute) degrades when the plurality of sheets P is conveyed over the fixing belt 21 continuously.

The through-holes 43*a* dissipate heat to the decreased thermal conductivity conductors 42*e* and 42*f* and cool the support side layer 43 effectively. Additionally, the through-holes 43*a* may engage positioning bosses 46 projecting from the decreased thermal conductivity conductors 42*e* and 42*f* of the intermediate layer 42 to secure the support side layer 43 to the intermediate layer 42. The increased thermal conductivity conductors 42*a*, 42*b*, 42*c*, and 42*d* of the intermediate layer 42 include through-holes 47 through which the positioning bosses 46 are inserted, respectively, to secure the increased thermal conductivity conductors 42*a*, 42*b*, 42*c*, and 42*d*, together with the decreased thermal conductivity conductors 42*e* and 42*f*, to the support side layer 43. Optionally, the fixing device 20T may include a cooler (e.g., a fan) that cools the support side layer 43. The support side layer 43 may be connected to or mounted on a structure to conduct heat to the structure and dissipate heat from the structure.

With reference to FIGS. 10 to 13, a description is provided of yet another mechanism to increase heat dissipation from the nip formation pad 26.

Figure 10:
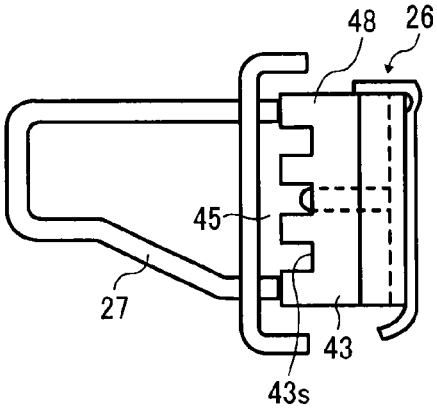
FIG. 10 is a sectional view of the nip formation pad and the stay incorporated in the fixing device shown in FIG. 4, illustrating ribs mounted on the nip formation pad.
Figure 11:
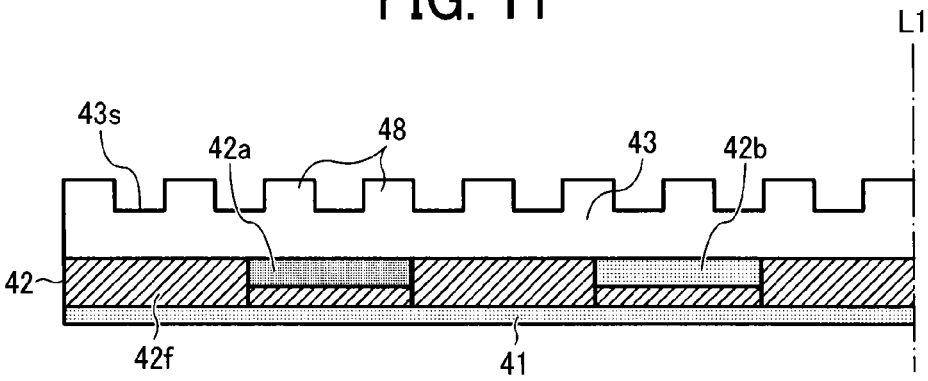
FIG. 11 is a partial sectional view of the support side layer, the intermediate layer, and the nip side layer of the nip formation pad shown in FIG. 10.

FIG. 10 is a sectional view of the nip formation pad 26 and the stay 27. FIG. 11 is a partial sectional view of the support side layer 43, the intermediate layer 42, and the nip side layer 41 of the nip formation pad 26. As shown in FIGS. 10 and 11, a plurality of ribs 48 is mounted on a support side face 43*s* of the support side layer 43 to produce irregularities on the support side face 43*s* and increase the surface area of the support side layer 43, thereby enhancing heat dissipation from the support side layer 43. The surface area of the support side layer 43 increased by the ribs 48 facilitates heat dissipation from the support side layer 43. Additionally, the ribs 48 projecting from the support side layer 43 toward the stay 27 in a direction perpendicular to the support side face 43*s* of the support side layer 43 do not obstruct heat dissipation by an upward current.

Figure 12:
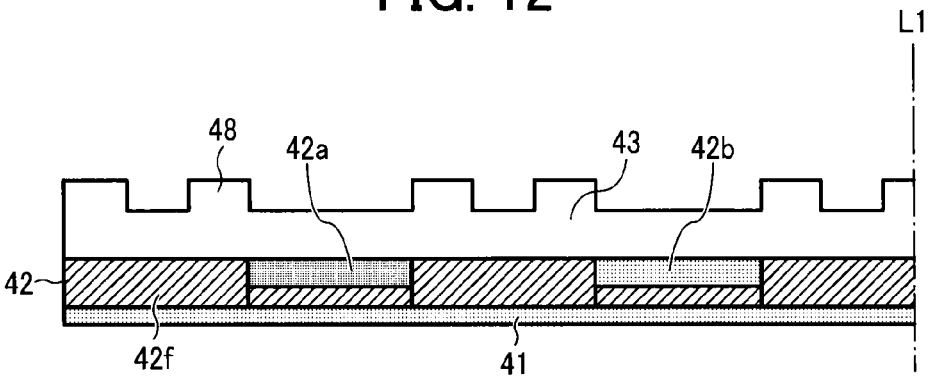
FIG. 12 is a partial sectional view of the support side layer, the intermediate layer, and the nip side layer of the nip formation pad shown in FIG. 10, illustrating a variation of the ribs.

FIG. 12 is a partial sectional view of the support side layer 43, the intermediate layer 42, and the nip side layer 41 of the nip formation pad 26 illustrating a variation of the ribs 48. The ribs 48 shown in FIG. 11 are aligned in the longitudinal direction of the nip formation pad 26 with an identical interval between the adjacent ribs 48. Alternatively, the ribs 48 may be aligned in the longitudinal direction of the nip formation pad 26 with various intervals varying depending on a length of the increased thermal conductivity conductors 42*a*, 42*b*, 42*c*, and 42*d* of the intermediate layer 42 in the longitudinal direction of the nip formation pad 26 as shown in FIG. 12. Since the increased thermal conductivity conductors 42*a*, 42*b*, 42*c*, and 42*d* are made of a rigid material such as copper, the rigidity of the nip formation pad 26 is uneven in the longitudinal direction thereof. For example, a portion of the nip formation pad 26 made of a material having a decreased thermal conductivity such as resin has a decreased mechanical strength against bending. Contrarily, a portion of the nip formation pad 26 made of a material having an increased thermal conductivity such as copper has an increased mechanical strength against bending.

Figure 13:
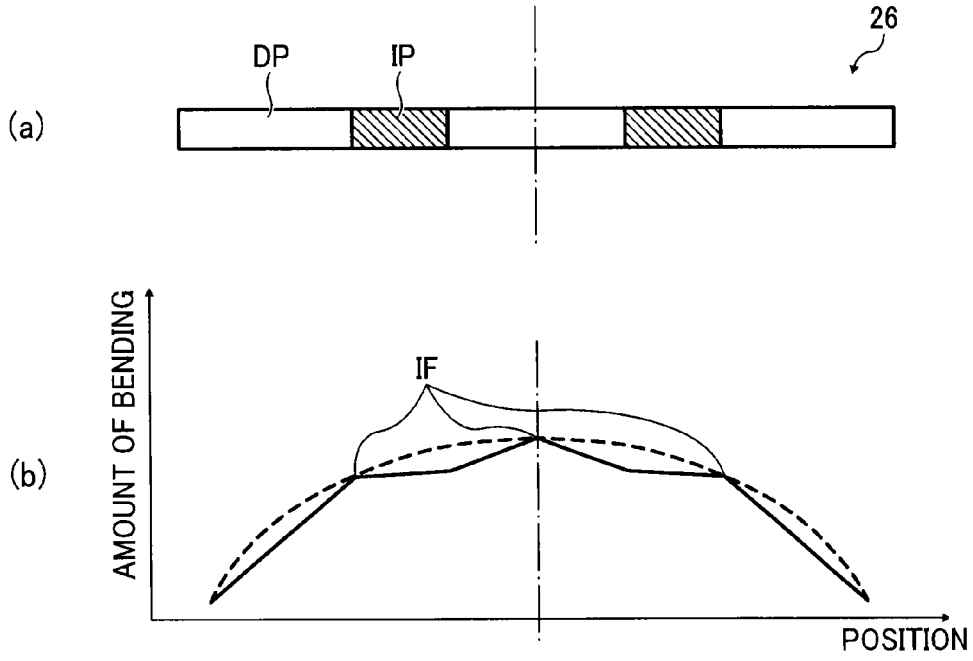
FIG. 13 illustrates a schematic horizontal sectional view of the nip formation pad shown in FIG. 6 and a graph showing a relation between a position of the nip formation pad in a longitudinal direction thereof and an amount of bending of the nip formation pad.

FIG. 13 illustrates a schematic horizontal sectional view of the nip formation pad 26 illustrating the increased thermal conduction portion IP and the decreased thermal conduction portion DP and a graph showing a relation between a position of the nip formation pad 26 in the longitudinal direction thereof and an amount of bending of the nip formation pad 26. If the nip formation pad 26 is bent continuously as shown in the dotted line in FIG. 13 as the nip formation pad 26 receives load from the pressure roller 22, the fixing nip N through which the sheet P is conveyed has no inflection point and maintains an even length in the sheet conveyance direction A1 throughout the entire width of the nip formation pad 26 in the longitudinal direction thereof. Thus, the nip formation pad 26 does not degrade quality of the toner image fixed on the sheet P. However, if the rigidity of the nip formation pad 26 is uneven in the longitudinal direction thereof as described above, the fixing nip N may have inflection points IF that may excessively increase or decrease pressure exerted on a part of the sheet P, varying gloss of the toner image fixed on the sheet P and resulting in formation of a faulty toner image on the sheet P.

To address this circumstance, the ribs 48 are aligned with an increased interval corresponding to and disposed opposite each of the rigid, increased thermal conductivity conductors 42*a*, 42*b*, 42*c*, and 42*d* as shown in FIG. 12, reducing the inflection points IF of the fixing nip N caused by variation in rigidity of the nip formation pad 26 and thereby attaining formation of a high quality toner image on the sheet P. Conversely, the ribs 48 are aligned with a decreased interval corresponding to and disposed opposite the decreased thermal conductivity conductor 42*f*.

With reference to FIGS. 14 to 19, a description is provided of a construction of a nip formation pad 26S according to another exemplary embodiment. Identical reference numerals are assigned to components of the nip formation pad 26S that are common to the nip formation pad 26 depicted in FIG. 5 and description of those components is omitted.

Figure 14:
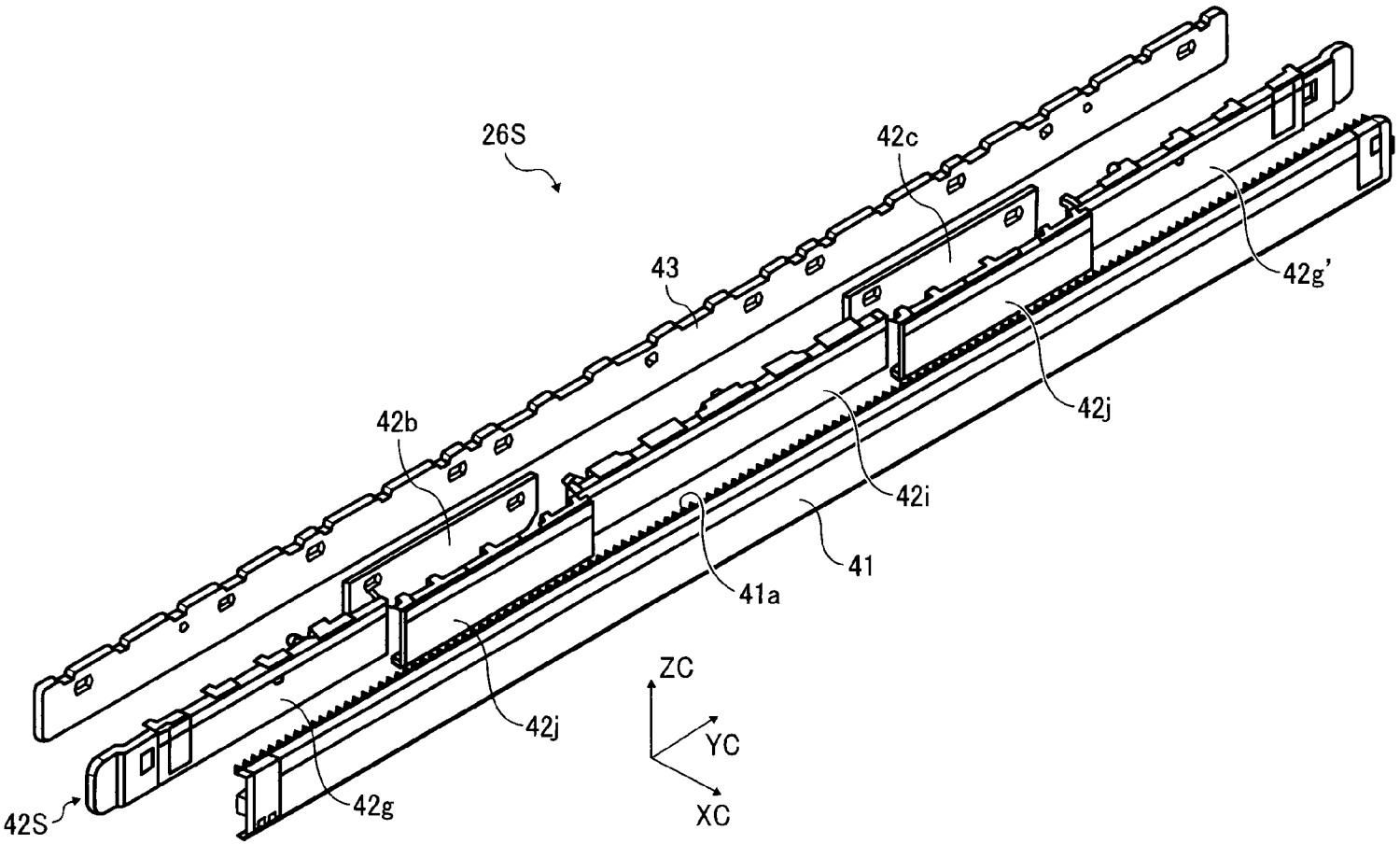
FIG. 14 is an exploded perspective view of a nip formation pad according to another exemplary embodiment.
Figure 15:
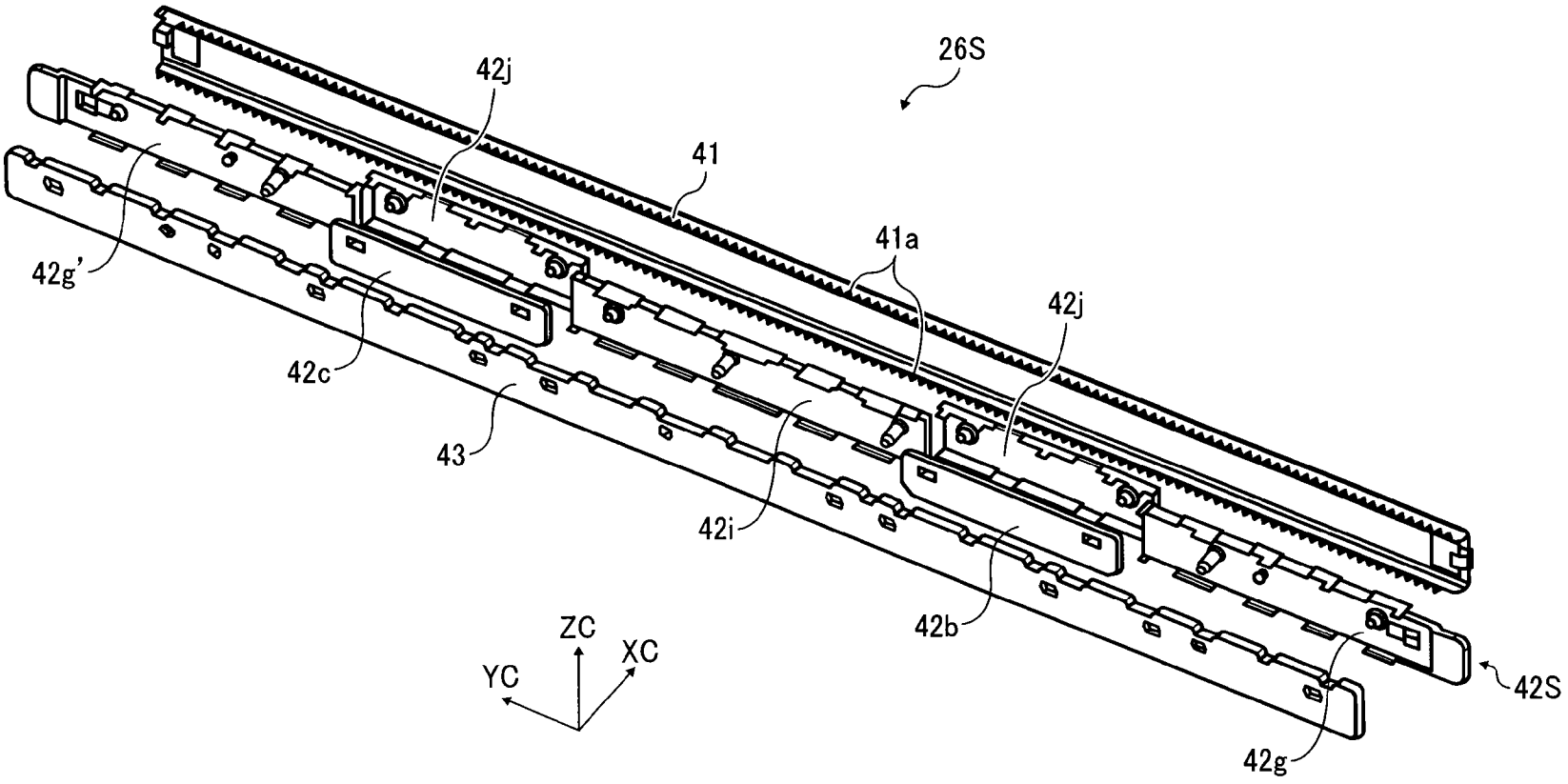
FIG. 15 is an exploded perspective view of the nip formation pad shown in FIG. 14 seen from a support side layer thereof.

The nip formation pad 26S includes an intermediate layer 42S serving as a multi-conductivity layer having two increased thermal conductivity conductors 42*b* and 42*c* aligned in a longitudinal direction of the nip formation pad 26S. Alternatively, the intermediate layer 42S may include four increased thermal conductivity conductors 42*a*, 42*b*, 42*c*, and 42*d* as shown in FIG. 5. The intermediate layer 42 of the nip formation pad 26 depicted in FIG. 5 includes the first layer constructed of the decreased thermal conductivity conductor 42*e* and the second layer layered on the first layer and constructed of the increased thermal conductivity conductors 42*a*, 42*b*, 42*c*, and 42*d* and the decreased thermal conductivity conductors 42*f* sandwiching each of the increased thermal conductivity conductors 42*a*, 42*b*, 42*c*, and 42*d*. Conversely, the intermediate layer 42S of the nip formation pad 26S depicted in FIGS. 14 and 15 is constructed of a decreased thermal conduction portion DP depicted in FIG. 6 incorporating a decreased thermal conductivity conductor and not incorporating an increased thermal conductivity conductor and an increased thermal conduction portion IP depicted in FIG. 6 incorporating a decreased thermal conductivity conductor and an increased thermal conductivity conductor. The decreased thermal conductivity conductor (e.g., a center portion 42*i* and lateral end portions 42*g* and 42*g*') of the decreased thermal conduction portion DP is separately provided from the decreased thermal conductivity conductor (e.g., the bridge portion 42*j*) of the increased thermal conduction portion IP.

FIG. 14 is an exploded perspective view of the nip formation pad 26S seen from the nip side layer 41. FIG. 15 is an exploded perspective view of the nip formation pad 26S seen from the support side layer 43 opposite the nip side layer 41 and facing the stay 27 depicted in FIG. 2. As shown in FIG. 14, the intermediate layer 42S is constructed of the center portion 42*i* having a decreased thermal conductivity; the lateral end portions 42*g* and 42*g*' having a decreased thermal conductivity; the bridge portions 42*j* having a decreased thermal conductivity; and the increased thermal conductivity conductors 42*b* and 42*c*. As shown in FIG. 15, teeth 41*a* are mounted on both ends of the nip side layer 41 in the sheet conveyance direction A1 defined by a direction ZC. The teeth 41*a* extend in the longitudinal direction of the nip formation pad 26S defined by a direction YC to catch or engage a low-friction slide sheet. Thus, the teeth 41*a* serve as a displacement stopper that prevents the slide sheet from being displaced. Alternatively, the teeth 41*a* may be situated at an upstream end of the nip side layer 41 in the sheet conveyance direction A1 corresponding to the rotation direction R3 of the fixing belt 21.

A detailed description is now given of the thickness of the components of the nip formation pad 26S in a thickness direction thereof defined by a direction XC when a nip length of the fixing nip N in the sheet conveyance direction A1 is about 10 mm.

The nip side layer 41 has a thickness in a range of from about 0.2 mm to about 1.0 mm. The support side layer 43 has a thickness in a range of from about 1.8 mm to about 6.0 mm. Each of the increased thermal conductivity conductors 42*b* and 42*c* serving as a heat absorption plate has a thickness in a range of from about 1.0 mm to about 2.0 mm.

The bridge portion 42*j* serving as a heat absorption restraint plate has a thickness in a range of from about 0.5 mm to about 1.5 mm. Each of the center portion 42*i* and the lateral end portions 42*g* and 42*g*' having a decreased thermal conductivity has a thickness in a range of from about 1.5 mm to about 3.5 mm. However, the thickness of those components is not limited to the above.

A detailed description is now given of a construction of the center portion 42*i* of the intermediate layer 42S.

Figure 16A:
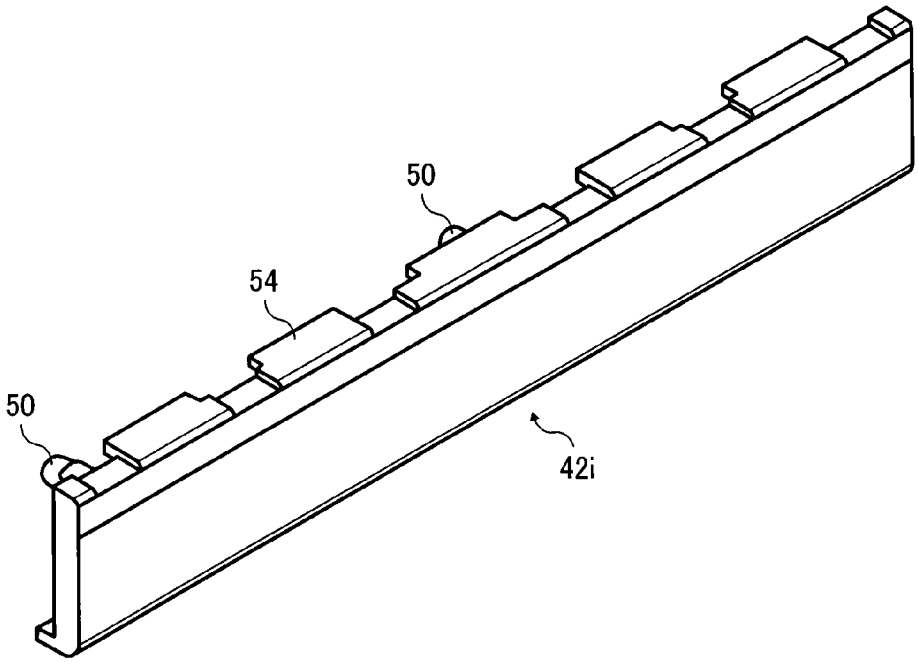
FIG. 16A is a perspective view of a center portion of an intermediate layer of the nip formation pad shown in FIG. 14 seen from a fixing nip formed between a fixing belt and a pressure roller incorporated in the fixing device shown in FIG. 2.
Figure 16B:
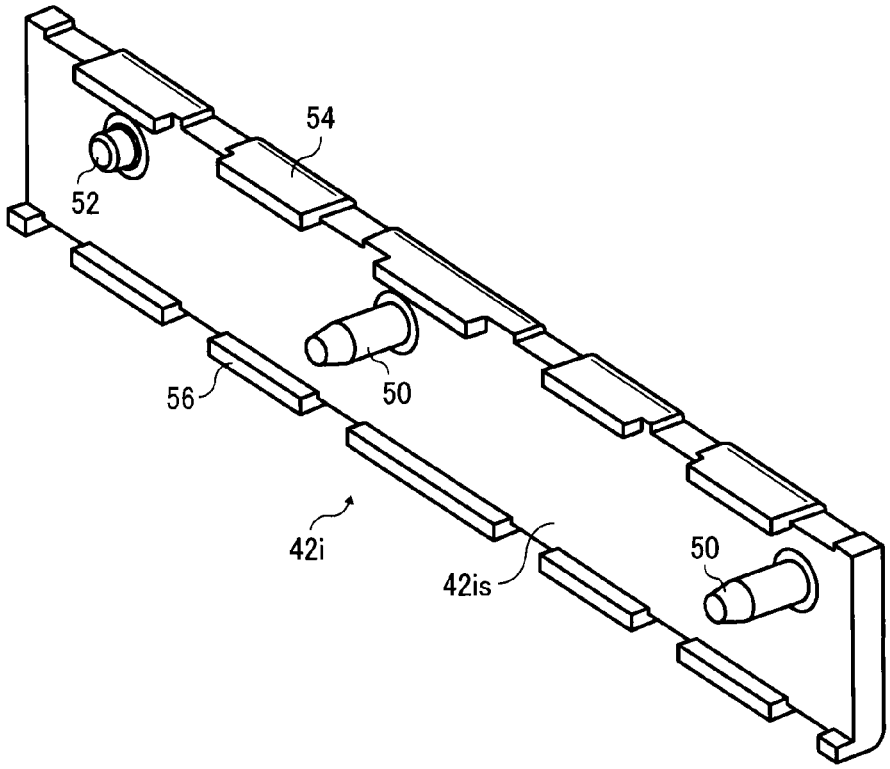
FIG. 16B is a perspective view of the center portion of the intermediate layer shown in FIG. 16A seen from a stay incorporated in the fixing device shown in FIG. 2.

FIG. 16A is a perspective view of the center portion 42*i* of the intermediate layer 42S seen from the fixing nip N. FIG. 16B is a perspective view of the center portion 42*i* of the intermediate layer 42S seen from the stay 27 disposed opposite the fixing nip N via the nip formation pad 26S. As shown in FIG. 16B, two ribs 50 and a single rib 52 project from a stay side face 42*is* of the center portion 42*i*. The ribs 50 penetrate through through-holes penetrating through the support side layer 43 having an increased thermal conductivity depicted in FIG. 15 and reach the stay 27 depicted in FIG. 2. The rib 52 engages a positioning through-hole or a recess produced in the support side layer 43. A plurality of marginal projections 54 and 56 projects from both ends of the center portion 42*i* in a short direction thereof, respectively, and extends in a longitudinal direction of the center portion 42*i*. The support side layer 43 is fitted between the marginal projections 54 and 56 and secured to the center portion 42*i*.

A detailed description is now given of a construction of the lateral end portion 42*g* of the intermediate layer 42S.

Figure 17A:
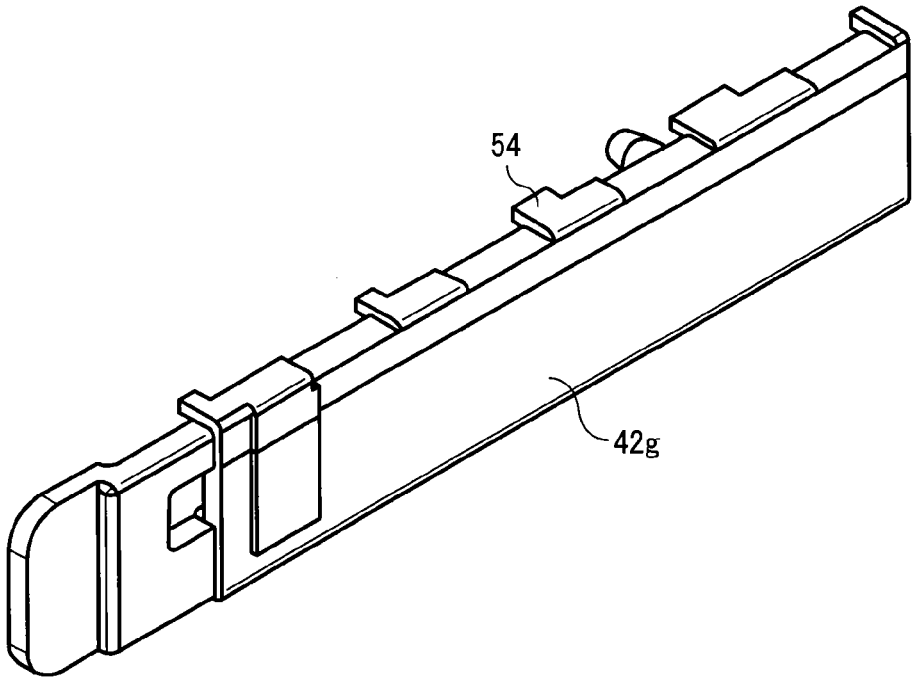
FIG. 17A is a perspective view of a lateral end portion of the intermediate layer of the nip formation pad shown in FIG. 14 seen from the fixing nip.
Figure 17B:
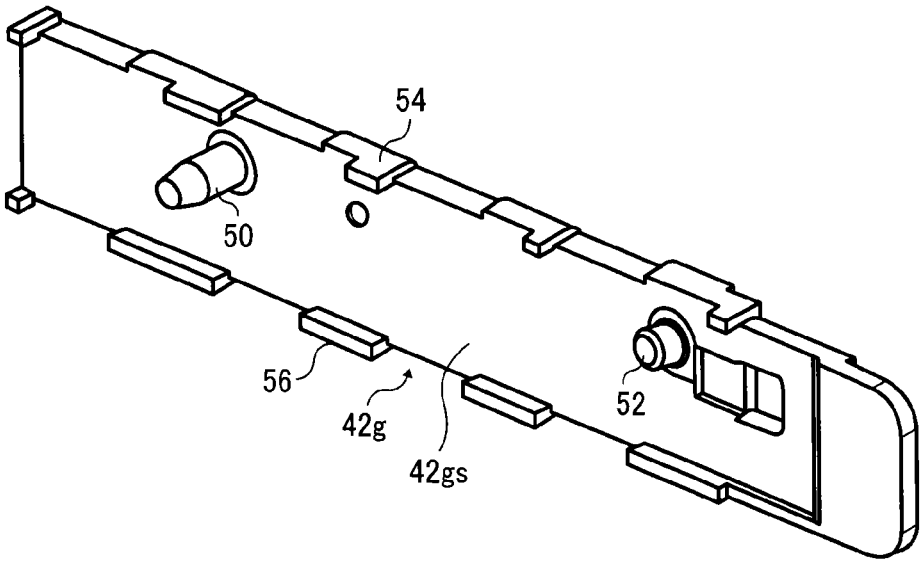
FIG. 17B is a perspective view of the lateral end portion of the intermediate layer shown in FIG. 17A seen from the stay.

FIG. 17A is a perspective view of the lateral end portion 42*g* of the intermediate layer 42S seen from the fixing nip N. FIG. 17B is a perspective view of the lateral end portion 42*g* of the intermediate layer 42S seen from the stay 27 disposed opposite the fixing nip N via the nip formation pad 26S. As shown in FIG. 17B, a single rib 50 and a single rib 52 project from a stay side face 42*gs* of the lateral end portion 42*g*. The rib 50 penetrates through the support side layer 43 depicted in FIG. 15 and reaches the stay 27 depicted in FIG. 2. The rib 52 engages the support side layer 43. Like the marginal projections 54 and 56 of the center portion 42*i* depicted in FIG. 16B, a plurality of marginal projections 54 and 56 projects from both ends of the lateral end portion 42*g* in a short direction thereof, respectively, and extends in a longitudinal direction of the lateral end portion 42*g*. As shown in FIGS. 14 and 15, the two lateral end portions 42*g* and 42*g*' are disposed at both lateral ends of the intermediate layer 42S in a longitudinal direction thereof, respectively. However, since the lateral end portions 42*g* and 42*g*' symmetrical with each other via the center portion 42*i* have symmetrical shapes in the longitudinal direction of the intermediate layer 42S, FIGS. 17A and 17B illustrate one of the two lateral end portions 42*g* and 42*g*', that is, the lateral end portion 42*g*.

A detailed description is now given of a construction of the bridge portion 42*j* of the intermediate layer 42S.

Figure 18A:
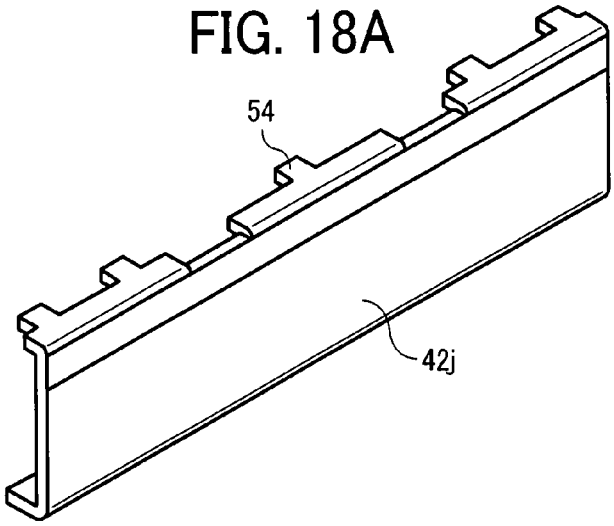
FIG. 18A is a perspective view of a bridge portion of the intermediate layer of the nip formation pad shown in FIG. 14 seen from the fixing nip.
Figure 18B:
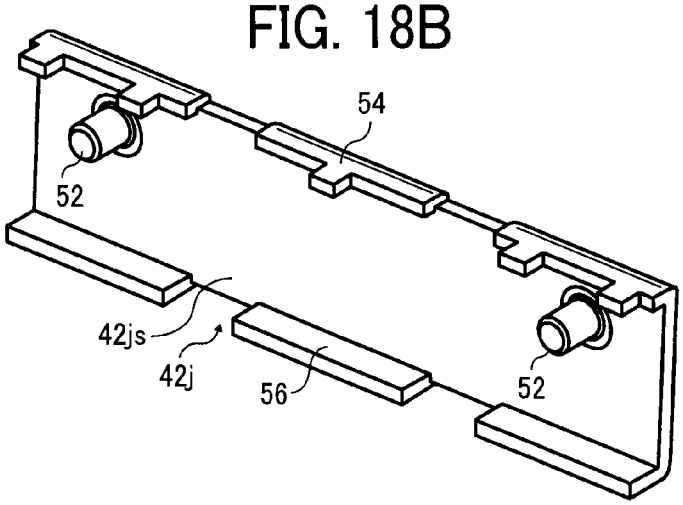
FIG. 18B is a perspective view of the bridge portion of the intermediate layer shown in FIG. 18A seen from the stay.

FIG. 18A is a perspective view of the bridge portion 42*j* of the intermediate layer 42S seen from the fixing nip N. FIG. 18B is a perspective view of the bridge portion 42*j* of the intermediate layer 42S seen from the stay 27 disposed opposite the fixing nip N via the nip formation pad 26S. As shown in FIG. 18B, two ribs 52 project from a stay side face 42*js* of the bridge portion 42*j*. The ribs 52 penetrate through through-holes penetrating through each of the increased thermal conductivity conductors 42*b* and 42*c* depicted in FIG. 15, respectively, and engage the support side layer 43. Like the marginal projections 54 and 56 of the center portion 42*i* depicted in FIG. 16B, a plurality of marginal projections 54 and 56 projects from both ends of the bridge portion 42*j* in a short direction thereof, respectively, and extends in a longitudinal direction of the bridge portion 42*j*. As shown in FIGS. 14 and 15, the intermediate layer 42S includes the two bridge portions 42*j*. However, since the two bridge portions 42*j* have identical or symmetrical shapes in the longitudinal direction of the intermediate layer 42S, FIGS. 18A and 18B illustrate one of the two bridge portions 42*j*.

Figure 19:
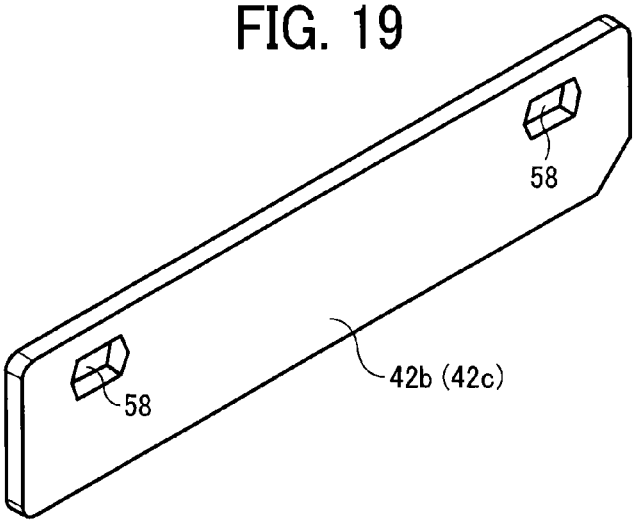
FIG. 19 is a perspective view of one of increased thermal conductivity conductors of the intermediate layer of the nip formation pad shown in FIG. 14.

With reference to FIG. 19, a detailed description is now given of a construction of the increased thermal conductivity conductors 42*b* and 42*c*.

FIG. 19 is a perspective view of one of the increased thermal conductivity conductors 42*b* and 42*c*. Two through-holes 58 penetrate through each of the increased thermal conductivity conductors 42*b* and 42*c* to engage the ribs 52 of the bridge portion 42*j* depicted in FIG. 18B, respectively. As shown in FIGS. 14 and 15, the intermediate layer 42S includes the two increased thermal conductivity conductors 42*b* and 42*c*. However, since the two increased thermal conductivity conductors 42*b* and 42*c* have symmetrical shapes in the longitudinal direction of the intermediate layer 42S, FIG. 19 illustrates one of the two increased thermal conductivity conductors 42*b* and 42*c*.

A description is provided of advantages of the fixing devices 20, 20S, and 20T depicted in FIGS. 2, 3, and 4, respectively.

The fixing devices 20, 20S, and 20T include the endless fixing belt 21 serving as an endless belt or a fixing rotator rotatable in the rotation direction R3; a heater (e.g., the halogen heaters 23) disposed opposite the fixing belt 21 to heat the fixing belt 21; a nip formation pad (e.g., the nip formation pads 26 and 26S) disposed opposite the inner circumferential surface of the fixing belt 21; the pressure roller 22 serving as a pressure rotator pressed against the nip formation pad via the fixing belt 21 to form the fixing nip N between the fixing belt 21 and the pressure roller 22 through which a sheet P serving as a recording medium is conveyed; and the stay 27 serving as a support disposed opposite the pressure roller 22 via the nip formation pad to support the nip formation pad against pressure or load from the pressure roller 22. As shown in FIGS. 5 and 14, the nip formation pad includes a plurality of layers having different thermal conductivities, respectively. The nip formation pad has different thermal conductivities to conduct heat in the thickness direction T26 of the nip formation pad perpendicular to the axial direction of the fixing belt 21 and the sheet conveyance direction A1. At least one of the plurality of layers of the nip formation pad, that is, a multi-conductivity layer (e.g., the intermediate layers 42 and 42S), has a thermal conductivity varying in the axial direction of the fixing belt 21. Another one of the plurality of layers of the nip formation pad, that is, the support side layer 43 contacting the stay 27, has a thermal conductivity greater than a thermal conductivity of the stay 27.

Accordingly, even when a lateral end of the fixing belt 21 in the axial direction thereof overheats as a plurality of small sheets P having the width W smaller than the heat generation span HA of the heater is conveyed continuously and the nip formation pad absorbs heat from the fixing belt 21 quickly, the nip formation pad facilitates movement of heat inside it and heat dissipation.

As shown in FIG. 5, the sheet P having the width W and the sheet P having the width Y, as they are conveyed over the fixing belt 21, are centered at the center line L1 in the axial direction of the fixing belt 21. Hence, the non-conveyance span of the fixing belt 21, outboard from the widths W and Y of the sheets P, where the sheets P are not conveyed over the fixing belt 21 is produced at each lateral end of the fixing belt 21 in the axial direction thereof. Alternatively, the sheets P may be aligned along one lateral edge of the fixing belt 21 in the axial direction thereof and the non-conveyance span of the fixing belt 21 may be defined along another lateral edge of the fixing belt 21 in the axial direction thereof.

According to the exemplary embodiments described above, the fixing belt 21 serves as an endless belt or a fixing rotator. Alternatively, a fixing film, a fixing sleeve, or the like may be used as an endless belt or a fixing rotator. Further, the pressure roller 22 serves as a pressure rotator. Alternatively, a pressure belt or the like may be used as a pressure rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a heater disposed opposite the fixing rotator to heat the fixing rotator;

a nip formation pad disposed opposite an inner circumferential surface of the fixing rotator;

a pressure rotator pressed against the nip formation pad via the fixing rotator to form a fixing nip between the fixing rotator and the pressure rotator, the fixing nip through which a recording medium is conveyed; and a support disposed opposite the pressure rotator via the nip formation pad to support the nip formation pad against pressure from the pressure rotator, the nip formation pad to conduct heat in a thickness direction thereof perpendicular to an axial direction of the fixing rotator and a recording medium conveyance direction, the nip formation pad including:

a multi-conductivity layer having a thermal conductivity varying in the axial direction of the fixing rotator; and a support side layer contacting the support and having a thermal conductivity greater than a thermal conductivity of the support.

2. The fixing device according to claim 1, wherein the nip formation pad further includes a nip side layer over which the fixing rotator slides, and wherein the multi-conductivity layer is sandwiched between the support side layer and the nip side layer and includes:

at least one increased thermal conductivity conductor having an increased thermal conductivity; and at least one decreased thermal conductivity conductor, having a decreased thermal conductivity, aligned with the increased thermal conductivity conductor in the axial direction of the fixing rotator.

3. The fixing device according to claim 2, further comprising a plurality of ribs aligned on the support side layer of the nip formation pad in the axial direction of the fixing rotator, wherein the plurality of ribs includes:

adjacent ribs aligned with a decreased interval therebetween, the decreased interval disposed opposite the decreased thermal conductivity conductor of the multi-conductivity layer; and adjacent ribs aligned with an increased interval therebetween, the increased interval disposed opposite the increased thermal conductivity conductor.

4. The fixing device according to claim 2, wherein the at least one decreased thermal conductivity conductor includes:

an inboard decreased thermal conductivity conductor; and an outboard decreased thermal conductivity conductor disposed outboard from the inboard decreased thermal conductivity conductor in the axial direction of the fixing rotator, and wherein the increased thermal conductivity conductor is sandwiched between the inboard decreased thermal conductivity conductor and the outboard decreased thermal conductivity conductor in the axial direction of the fixing rotator.

5. The fixing device according to claim 4, wherein the increased thermal conductivity conductor is disposed opposite a lateral end of a decreased size recording medium in the axial direction of the fixing rotator and a non-conveyance span of the fixing rotator in the axial direction thereof where the decreased size recording medium is not conveyed.

6. The fixing device according to claim 4, wherein the at least one increased thermal conductivity conductor includes:

an inboard increased thermal conductivity conductor; and an outboard increased thermal conductivity conductor disposed outboard from the inboard increased thermal conductivity conductor and the outboard decreased thermal conductivity conductor in the axial direction of the fixing rotator.

7. The fixing device according to claim 6, wherein the outboard increased thermal conductivity conductor is disposed opposite a lateral end of an increased size recording medium in the axial direction of the fixing rotator and a non-conveyance span of the fixing rotator in the axial direction thereof where the increased size recording medium is not conveyed.

8. The fixing device according to claim 6, wherein a thermal conductivity of the inboard increased thermal conductivity conductor is different from a thermal conductivity of the outboard increased thermal conductivity conductor.

9. The fixing device according to claim 1, further comprising a plurality of projections projecting from the support to contact the support side layer of the nip formation pad to support the nip formation pad, the projections to secure an air layer between the support and the support side layer of the nip formation pad.

10. The fixing device according to claim 1, further comprising a through-hole penetrating through the support side layer of the nip formation pad.

11. The fixing device according to claim 10, further comprising a boss, projecting from the multi-conductivity layer, to be inserted into the through-hole.

12. The fixing device according to claim 1, further comprising a plurality of ribs mounted on the support side layer of the nip formation pad.

13. The fixing device according to claim 12, wherein the plurality of ribs projects toward the support.

14. The fixing device according to claim 12, wherein the plurality of ribs includes adjacent ribs aligned in the axial direction of the fixing rotator with an identical interval therebetween.

15. The fixing device according to claim 1, wherein the multi-conductivity layer includes:

a center portion disposed at a center of the multi-conductivity layer in the axial direction of the fixing rotator;

a lateral end portion disposed at a lateral end of the multi-conductivity layer in the axial direction of the fixing rotator;

a bridge portion bridging the center portion and the lateral end portion in the axial direction of the fixing rotator; and an increased thermal conductivity conductor mounted on the bridge portion, and wherein a thermal conductivity of the increased thermal conductivity conductor is greater than a thermal conductivity of each of the center portion, the lateral end portion, and the bridge portion.

16. The fixing device according to claim 15, wherein the increased thermal conductivity conductor is disposed opposite a lateral end of the recording medium in the axial direction of the fixing rotator and a non-conveyance span of the fixing rotator in the axial direction thereof where the recording medium is not conveyed.

17. The fixing device according to claim 1, wherein the fixing rotator includes a fixing belt and the pressure rotator includes a pressure roller.

18. The fixing device according to claim 1, wherein the support includes a stay.

19. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a predetermined direction of rotation;

a heater disposed opposite the fixing rotator to heat the fixing rotator;

a nip formation pad disposed opposite an inner circumferential surface of the fixing rotator;

a pressure rotator pressed against the nip formation pad via the fixing rotator to form a fixing nip between the fixing rotator and the pressure rotator, the fixing nip through which a recording medium is conveyed; and a support disposed opposite the pressure rotator via the nip formation pad to support the nip formation pad against pressure from the pressure rotator, the nip formation pad to conduct heat in a thickness direction thereof perpendicular to an axial direction of the fixing rotator and the recording medium conveyance direction, the nip formation pad including:

a multi-conductivity layer having a thermal conductivity varying in the axial direction of the fixing rotator; and a support side layer contacting the support and having a thermal conductivity greater than a thermal conductivity of the support.

20. The fixing device according to claim 1, wherein the support is a metal support, and the support side layer contacts the metal support and has a thermal conductivity greater than a thermal conductivity of the metal support.

* * * * *